US011149444B2

(12) United States Patent
Bergelin et al.

(10) Patent No.: US 11,149,444 B2
(45) Date of Patent: Oct. 19, 2021

(54) SET OF DECKING BOARDS PROVIDED WITH A CONNECTING SYSTEM

(71) Applicant: Välinge Innovation AB, Viken (SE)

(72) Inventors: Marcus Bergelin, Lerberget (SE); Nils-Erik Engström, Trelleborg (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 16/467,062

(22) PCT Filed: Apr. 18, 2017

(86) PCT No.: PCT/SE2017/050384
§ 371 (c)(1),
(2) Date: Jun. 6, 2019

(87) PCT Pub. No.: WO2018/111168
PCT Pub. Date: Jun. 21, 2018

(65) Prior Publication Data

US 2019/0309527 A1 Oct. 10, 2019

(30) Foreign Application Priority Data

Dec. 16, 2016 (SE) ..... 1651663-5

(51) Int. Cl.
*E04F 15/02* (2006.01)
*E04B 1/41* (2006.01)
(Continued)

(52) U.S. Cl.
CPC ..... *E04F 15/02044* (2013.01); *E04B 1/003* (2013.01); *E04B 1/40* (2013.01);
(Continued)

(58) Field of Classification Search
CPC ..... E04F 15/02044; E04F 15/04; E04F 15/02183; E04F 2015/02094;
(Continued)

(56) References Cited

U.S. PATENT DOCUMENTS 2,115,936 A * 5/1938 Sterns ..... E04C 2/043 52/601
3,200,553 A 8/1965 Frashour et al.
(Continued)

FOREIGN PATENT DOCUMENTS

CA 2 792 923 A1 4/2013
CN 202695471 U 1/2013
(Continued)

OTHER PUBLICATIONS

U.S. Appl. No. 16/492,257, Bergelin.
(Continued)

*Primary Examiner* — Brent W Herring
(74) *Attorney, Agent, or Firm* — Buchanan Ingersoll & Rooney P.C.

(57) ABSTRACT

A set of decking boards including a first and a second decking board and being provided with a connecting system including a connecting device. The first board is configured to be connected to a support element and the second board is configured to assume a vertically locked state with respect to the first board in which the connecting device cooperates with the first and second boards, there is a vertical gap between a portion of the second lip of the first decking board and a portion of the second lip of the second decking board, and there is a horizontal space between a first lip of the first board and the second lip of the second board. Also, other aspects of a set of decking boards and connecting devices as well as methods for demounting decking boards and replacing them with new decking boards.

24 Claims, 15 Drawing Sheets

(51) Int. Cl.
*E04B 1/00* (2006.01)
*E04F 15/04* (2006.01)

(52) U.S. Cl.
CPC ..... *E04F 15/02183* (2013.01); *E04F 15/04* (2013.01); *E04F 2015/02094* (2013.01); *E04F 2015/02122* (2013.01)

(58) Field of Classification Search
CPC .... E04F 2015/02122; E04F 2201/0153; E04F 2201/0523; E04F 15/02; E04F 15/02033; E04F 15/02038; E04F 13/0826; E04F 13/085; E04F 2201/023; E04B 1/003; E04B 1/40
USPC ... 52/415, 474, 483.1, 489.1, 489.2, 506.01, 52/506.05, 512
See application file for complete search history.

(56) References Cited

U.S. PATENT DOCUMENTS 3,535,844 A * 10/1970 Glaros ..... E04D 3/352 52/592.1
3,667,180 A * 6/1972 Tischuk ..... E04F 13/0803 52/309.2
3,998,023 A * 12/1976 Anderson ..... E04C 2/365 52/592.1
3,998,024 A * 12/1976 Frandsen ..... E04C 2/365 52/592.1
4,122,641 A * 10/1978 Bard ..... E04C 2/292 52/396.06
4,123,885 A * 11/1978 Scott ..... E04F 13/0841 52/489.1
4,170,859 A 10/1979 Counihan
4,184,301 A * 1/1980 Anderson ..... E04B 1/6104 52/478
4,187,653 A * 2/1980 Kliewer, Jr. ..... E04B 2/60 52/98
4,316,351 A * 2/1982 Ting ..... E04C 2/292 52/309.9
4,765,107 A * 8/1988 Ting ..... E04B 1/6812 52/235
5,274,979 A * 1/1994 Tsai ..... E04C 2/292 52/588.1
5,277,011 A * 1/1994 Serrano Martin ..... E04C 2/292 52/309.9
5,394,667 A 3/1995 Nystrom
6,237,295 B1 * 5/2001 Ballard ..... E04F 15/10 52/391
6,260,326 B1 * 7/2001 Muller-Hartburg .... B28B 1/002 52/601
6,324,796 B1 12/2001 Heath
6,470,641 B1 10/2002 Faure
D485,160 S 1/2004 Pelc
6,857,243 B2 * 2/2005 Bloomfield ..... E04C 2/043 156/304.3
6,865,856 B2 * 3/2005 Kim ..... E04F 15/02 52/387
7,533,500 B2 5/2009 Morton et al.
8,291,666 B1 10/2012 Garrison
8,544,229 B2 10/2013 Kilgore et al.
8,728,609 B2 * 5/2014 Torres ..... E04D 1/08 428/157
9,140,020 B2 9/2015 Torres-Pinzon
9,181,715 B2 11/2015 Orchard
9,376,822 B2 * 6/2016 Hannig ..... E04F 13/0894
9,850,667 B2 * 12/2017 Engstrom ..... E04F 15/02044
2001/0027829 A1 10/2001 Crout
2002/0095897 A1 7/2002 Summerford
2006/0283126 A1 12/2006 Juan Puerta
2007/0066096 A1 3/2007 Gillis et al.
2007/0234670 A1 10/2007 Martel
2010/0205895 A1 8/2010 Orchard
2011/0067335 A1 3/2011 Gibson et al.
2012/0110944 A1 * 5/2012 Hess ..... E04F 15/02183 52/582.1
2013/0025228 A1 1/2013 Kilgore et al.
2013/0025230 A1 1/2013 Turner
2013/0104493 A1 5/2013 Orchard
2014/0165491 A1 6/2014 Lachevrotiere et al.
2014/0260041 A1 9/2014 Peck et al.
2014/0260043 A1 9/2014 Cottier
2015/0047278 A1 2/2015 Blount
2015/0176289 A1 * 6/2015 Hannig ..... F16B 5/008 52/582.2
2015/0368911 A1 12/2015 Kuijper
2016/0168867 A1 6/2016 Chester
2016/0233820 A1 8/2016 Redel
2017/0037643 A1 2/2017 Mitchell
2017/0044776 A1 2/2017 Rodriguez Lopez
2017/0058534 A1 * 3/2017 Engstrom ..... E04B 9/0435
2017/0314278 A1 11/2017 Lee et al.
2020/0217084 A1 * 7/2020 Ylikangas ..... E04F 15/02005

FOREIGN PATENT DOCUMENTS

CN 104775595 A 7/2015
CN 104831903 A 8/2015
CN 104947907 A 9/2015
CN 105281645 A 1/2016
DE 100 64 587 A 7/2002
DE 20 2007 002 282 U1 6/2008
DE 20 2009 007 507 U1 9/2009
DE 10 2008 051 441 A1 3/2010
DE 10 2009 031 825 A1 1/2011
DE 20 2011 107 843 U1 11/2011
DE 20 2010 004 268 U1 4/2012
DE 20 2011 106 654 U1 4/2012
DE 10 2013 109 845 3/2015
DE 10 2014 115 257 A1 4/2016
DE 20 2016 001 234 U1 6/2016
EP 1 106 842 A1 6/2001
EP 1 567 731 B1 3/2007
EP 2 096 232 A1 9/2009
EP 2 711 481 A1 3/2014
EP 2 816 172 A2 12/2014
EP 2 899 330 A1 7/2015
EP 3 090 850 A1 11/2016
EP 3 112 551 A1 1/2017
EP 3 112 554 A1 1/2017
FR 2 843 414 2/2004
FR 2 914 670 A1 10/2008
FR 3032739 A1 8/2016
JP 2008-031827 A 2/2008
JP 2010-242365 A 10/2010
JP 2011-069155 A 4/2011
JP 5313012 B2 10/2013
JP 2014-214498 A 11/2014
KR 2009-0117287 A 11/2009
KR 10-0944453 B1 3/2010
KR 10-1042682 B1 6/2011
KR 2012-0032096 A 4/2012
KR 2013-0056702 A 5/2013
KR 2016-0025167 A 3/2016
WO WO 2014/179838 A1 11/2014
WO WO 2015/159136 A1 10/2015
WO WO 2015/174835 A1 11/2015
WO WO 2018/169483 A1 9/2018

OTHER PUBLICATIONS

U.S. Appl. No. 16/720,752, Ylikangas et al.
International Search Report and Written Opinion issued in PCT/SE2017/050384, dated Sep. 5, 2017, Patent-och registreringsverket, Stockholm, SE, 17 pages.
Bergelin, Marcus, U.S. Appl. No. 16/492,257 entitled "Connecting Device, Support Element and Connecting System for Boards," filed in the U.S. Patent and Trademark Office on Sep. 9, 2019.
Ylikangas, Roger, et al., U.S. Appl. No. 16/720,752 entitled "Flooring System Provided with a Connecting System and an Associated Connecting Device," filed in the U.S. Patent and Trademark Office on Dec. 19, 2019.

(56) References Cited

OTHER PUBLICATIONS

Extended European Search Report issued in EP 17881897.7, dated Jul. 20, 2020, European Patent Office, Munich, DE, 11 pages.

* cited by examiner

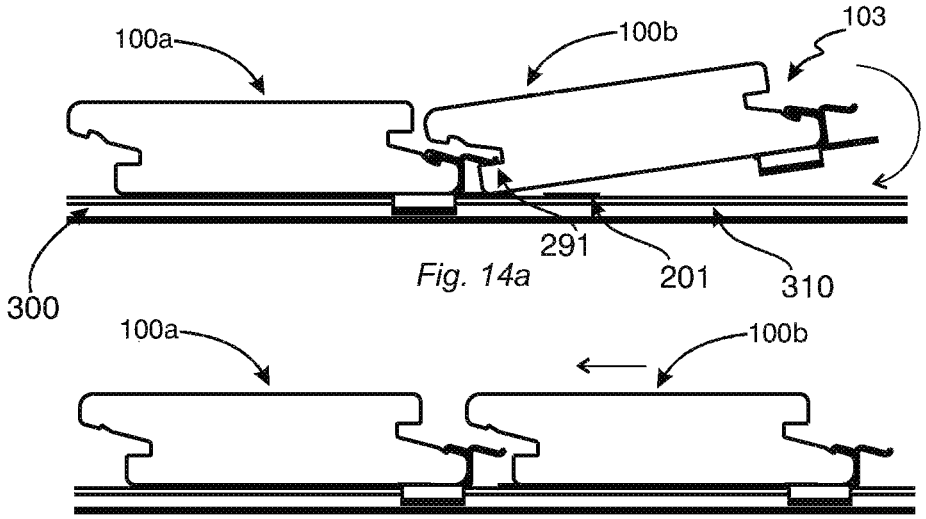
Fig. 14a
Fig. 14b
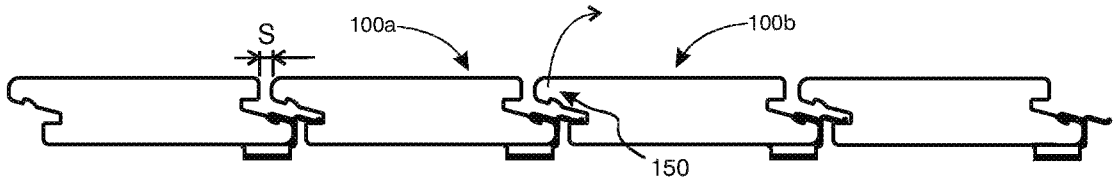
Fig. 14c
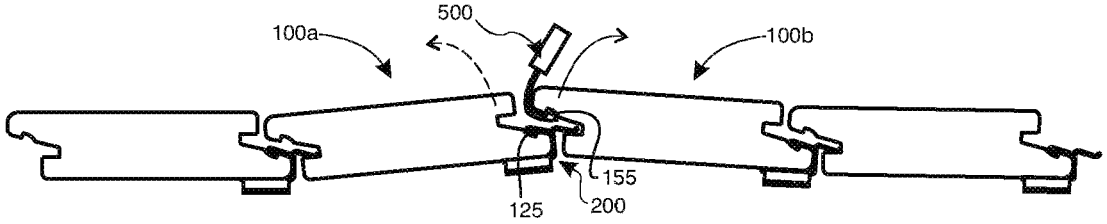
Fig. 14d
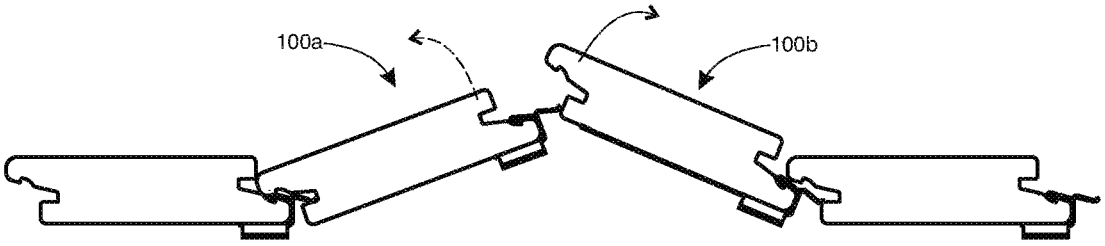
Fig. 14e

SET OF DECKING BOARDS PROVIDED WITH A CONNECTING SYSTEM

TECHNICAL FIELD

The disclosure generally relates to flooring and decking. More specifically, the disclosure relates to a set of decking boards provided with a connecting system comprising a connecting device, such as a clip. The disclosure also relates to the connecting device and a method of demounting a set of interlocked decking boards.

BACKGROUND

Decking is typically utilized as outdoor floor constructions in the vicinity or in connection to a building. Decking panels are usually arranged at an elevated level above a ground. The decking panels may be made of treated or composite lumber, aluminium, or other materials. The decking panels may be installed by means of separate clamps that are attached to a joist structure. The clamps hold the decking panels in place and may define a uniform gap between the decking panels. Adjacent decking panels may comprise overlapping lips, thereby concealing the joist structure provided below the panels.

However, the decking panels in the prior art suffer from several drawbacks, especially in the case when they are made of a relatively soft material, a low-quality material, a cheap material, or a low-density material. Known panels utilizing separate clamps and overlapping lips are hard or even impossible to demount without damaging one or several panels. Indeed, in order to remove a panel, a portion of the panel ordinarily has to be cut in order to be able to access the clamp. One reason for this disadvantage is because the panels are arranged to be installed sequentially in one row after another. According to methods in the state of the art, there is no possibility to remove a panel in the middle of the sequence of panels without removing all of the panels that have been installed subsequently in the sequence of panels.

As a consequence, a new panel that will replace a removed panel cannot be installed in the same manner as the previous ones, since they require a sequential arrangement. Thus, the new panel has to be installed by a different method, for example by cutting it appropriately and fixing it by screwing or by gluing it to the joist structure in an ad hoc manner. The first example may result in a less attractive appearance of the panel, since screws may become visible, and the second example may result in a panel which is not attached to the joist structure properly, since glue may provide less fixation than screws.

Additionally, known panels utilizing separate clamps and overlapping lips typically run the risk of being damaged when they are installed, since they are provided with a rather weak groove and lip structure that are arranged to house the clamp. During installation, a screw is screwed through parts of the weak structure and is provided through the clamp. As a result, the weak structure may become deformed or even damaged.

Finally, panels installed according to known principles may become deformed due to environmental conditions, such as temperature changes and humidity variations, whereby the panels become displaced from their initial positions, and may as a result also be damaged.

SUMMARY OF THE INVENTION

It is therefore an objective of the present inventive concept to provide a set of decking boards provided with a connecting system comprising a connecting device that allows for an improved procedure of replacing individual decking boards in the set of decking boards.

Another object is to provide a set of decking boards that are more resistant to damage during demounting and installation of decking boards.

It is also an object to provide a corresponding method of demounting a set of interlocked decking boards.

It is a further object to provide a connecting device for connecting decking boards.

According to a first aspect of the inventive concept, there is provided set of decking boards provided with a connecting system comprising a connecting device. The set of decking boards comprises a first decking board comprising a first side portion and a second decking board comprising a second side portion, each side portion extending along a longitudinal direction of the decking board. Each of the first and second side portions comprises a first lip and a second lip, wherein an extension of the second lip in a transverse direction of the decking board is larger than an extension of the first lip in the transverse direction of the decking board. The first decking board is configured to be connected to a support element. The second decking board is configured to assume a vertically locked state with respect to the first decking board, wherein in the vertically locked state: the connecting device cooperates with the first decking board and with the second decking board; preferably, the first lip of the first decking board and the second lip of the second decking board are provided in a first horizontal plane, and the second lip of the first decking board and the first lip of the second decking board are provided in a second horizontal plane, the first and second horizontal planes each being parallel with a surface member of the first and/or the second decking board; there is a vertical gap between a portion of the second lip of the first decking board and a portion of the second lip of the second decking board; and there is a horizontal space between the first lip of the first decking board and the second lip of the second decking board.

Thus, at least a portion of the first lip of the first board and at least a portion of the second lip of the second board may be provided at the same distance from a surface member of the first and/or the second board. Moreover, at least a portion of the second lip of the first board and at least a portion of the first lip of the second board may be provided at the same distance from a surface member of the first and/or the second board.

The transverse direction of the board is a horizontal direction perpendicular to the longitudinal direction of the board. The transverse direction is also perpendicular to a surface normal of a surface member of the board.

The connection of a board to the support element may be a horizontal and/or a vertical connection, preferably a fixation.

An "installed state" of a board is a state in which the board is connected to the support element, and/or vertically locked with respect to an adjacent board. By a first board being "adjacent" to a second board is meant that the first board is arranged next to the second board and the first side portion of the first board preferably is facing the second side portion of the second board.

In the present disclosure, by a "vertically locked state" of a board with respect to an adjacent board, such as the second board assuming a vertically locked state with respect to the first board, may be that the board, preferably a side portion of the board, is locked with respect to the adjacent board at least in a direction perpendicular to the front side and/or rear side of the board, and/or in a direction perpendicular to a horizontal plane provided in top portions of the support element. Optionally, the board, preferably the side portion of the board, may also be partially or even completely locked in a horizontal direction with respect to the adjacent board, preferably an adjacent side portion, such as in the transverse and/or the longitudinal direction of the board. The vertically locked state may be a vertically locked position.

The surface member of each board has an extension along the longitudinal direction and along the transverse direction of the board. The extension along the longitudinal direction preferably is larger that the extension along the transverse direction. The surface member of each board may be one of a first and a second surface member of the board. Preferably, the first and second surface members are parallel to each other. Moreover, the first and second surface members preferably are planar or substantially planar. The first and second surface members may nevertheless comprise portions that are non-planar and/or having a structure, such as an ornamental design, a wood surface, a wood imitation, an embossing, a debossing, bevels, ridges, grooves, cavities, or similar.

The first surface member may correspond to a front side, or visible side, of the board and the second surface member may correspond to a rear side of the board in an installed state of the board, or vice versa.

In an installed state of the first and second boards, the front sides of the first and second boards are preferably arranged in the same, or essentially the same, horizontal plane.

Each board preferably further comprises an opposed side portion extending along the longitudinal direction of the board. The opposed side portion is provided opposite to the side portion in the transverse direction. The opposed side portion of the first and second board may be a second and a first side portion, respectively. A second side portion of a third board may be installed adjacent to the first side portion of the second board. The second side portion of the first board may be installed adjacent to a first side portion of a previously installed board. Each installation may be the same as for the first and second boards in accordance with the above.

Preferably, the first and/or second side portions of a board extend along the entire longitudinal direction of the board.

The first and second side portions of a board may comprise, or may be, a first and a second longitudinal side edge of the board, respectively.

Each opposed side portion may comprise a first lip and a second lip, wherein an extension of the second lip in a transverse direction of the board is larger than an extension of the first lip in the transverse direction of the board. The transverse extensions of the first and/or second lips may be the same, or substantially the same, on the side portion and on the opposed side portion. Thereby, at least a portion of each board may be substantially symmetric under a 180 degrees rotation around a longitudinal axis of the board. In particular, the entire first and second side portions may be substantially symmetric in accordance with the above. By being substantially symmetric the board may assume the same vertically locked state before and after rotation of the board. Another advantage of having a symmetric board is that the orientation of the board in the installed state may be chosen depending on the curvature of the board, especially along the longitudinal and/or the transverse direction. As a result of the above, the board also may become easier to manufacture.

In accordance with the inventive concept, the first and/or the second boards may be demounted after installation with little or even no damage of any board, in particular when installed in conjunction with an plurality of other boards provided next to the first and the second boards and installed in the same way as the first and second boards. The boards may be removed by disconnecting the connecting device and by angling and/or displacing one or both of the boards away from the support element. Moreover, new boards, replacing any removed board, may be installed in a simple way by reversing the angling and/or displacing action. Thereby, individual boards may be replaced in an improved manner.

The boards may be installed sequentially, e.g. one row at a time, while at the same time allowing for individual boards being removed without having to remove the entire row of installed boards between that individual board and a board installed in an end row or a start row.

Another advantage compared to the teachings in the prior art is that the first and second lips of the may be made thicker which makes the boards more robust. Since the board is not damaged as easily, the board may be re-used.

By decking board or deck board is meant a board, panel, tile or plank or similarly that is configured to be provided on a support element. Throughout the disclosure, the short-hand notation "board" will often be used. The board may be installed indoors and/or outdoors. The board may comprise at least one of softwood, hardwood, lumber, a plastic material, such as PVC, PP, PE, wood fibres or metal(s), such as aluminium. The board may comprise a mix of one or several of these materials. In a first example, the board is made of softwood, such as cedar, larch, fir, redwood or pine. In a second example, the board is composite lumber or a Wood-Plastic Composite (WPC) decking board, comprising wood fibres or wood flour and plastics, preferably a thermoplastic, and optionally a filler and/or a binding agent. In a third example, the board is made of hardwood, such as Ipe, Yellow Balau, or Teak. In a fourth example, the board comprises bamboo or *eucalyptus*. The board may comprise a protective layer for protecting the board against one or several of wear, moist, heat, sunlight, etc. Any of the boards above may be pressure treated.

The set of boards may comprise further boards, such as a third decking board, a fourth decking board, etc. In particular, there may be a plurality of decking boards.

Throughout the present disclosure, when referring simply to a board, it is understood that it may refer to any board in the set of boards.

The boards in the set of boards preferably have one or several essentially identical characteristics, such as shape, material, weight, dimensions, colours, designs, protective layers, etc. The boards may be substantially identical. However, it is conceivable that some boards in the set of boards have different characteristics, such as different designs.

Preferably, the connecting device is a separate connecting device and preferably is mounted to the boards during their installation.

The connecting device may be a clip, a clamp, a clasp, a catch, a hook, a spring clip, etc. The connecting device may comprise a metal, such as stainless steel or aluminium, an alloy, such as an aluminium alloy, e.g. a 6060 aluminium alloy, such as 6060-T6, or a plastic, such as thermoplastic, e.g. polypropylene, nylon, acrylonitrile butadiene styrene (ABS) or acrylonitrile styrene acrylate (ASA), or a combination of any of these materials. The connecting device, e.g. comprising thermoplastic, may comprise a glass-fibre material for reinforcement. The connecting device may comprise a plastic or a metal, e.g. aluminium, that may be injection moulded or extruded.

The connecting device may be provided on or connected to the support element by means of an attaching element. The attaching element may be a screw, nail, bolt, rivet, stapler, flange, tape, adhesive, such as glue, or another fastener known to a person skilled in the art.

Moreover, the connecting device may be provided on or connected to the support element by means of flanges provided on the connecting device. For example, the flanges may be snapped or bended onto the support element, e.g. a joist.

The connecting device may be horizontally connected relative to the first board in an installed state, transversely and/or longitudinally.

The connecting device may comprise a first and a second engagement portion configured to engage with the first and second board, respectively, in an installed state. There may be an intermediate portion connecting the first and second engagement portion. The second engagement portion may comprise a bevel or a rounded portion for simplifying an insertion of the connecting device into a groove of the second board. The first and second engagement portions may be configured to be provided at different levels, preferably vertical levels, from the support member in an installed state.

A shape of the connecting device may be such that, when it is placed on the inner wall of the second lip, it has a balanced torsional moment. In particular, this means that it does not fall off the second lip when placed there, thereby giving rise to a simplified installation of the connecting device.

The connecting device may comprise a positioning portion being configured to position the connecting device with respect to the first board in the transverse direction. Thereby, a uniform distance between adjacent boards may be provided and it may be easier to position the connecting device with respect to a guiding means for an attaching element, such as a notch, or a hole, such as a blind hole or a through hole, in the board where or through which an attaching element is configured to be provided.

The connecting device may be a first connecting device. The set of boards may comprise a second connecting device configured to cooperate with the second board and a third board. In particular, the set of boards may comprise a plurality of connecting devices, preferably along the longitudinal direction of the boards, each cooperating with a pair of adjacent boards.

The connecting device preferably extends only along a portion of the board in a longitudinal direction in an installed state. Thereby, a strong connecting system may be provided while keeping a material consumption small. In non-limiting embodiments, the connecting device may have a horizontal extension 20 mm-60 mm, a vertical extension 20 mm-40 mm, and an extension 10 mm-60 mm in a direction perpendicular to the horizontal and vertical directions.

According to one embodiment, the connecting device is operable and/or accessible, and optionally visible, through the horizontally space. Thereby, an arbitrary board in the set of boards may be removed without any substantial damage to any board. In another embodiment, the connecting device is partly or completely concealed.

Alternatively, the connecting device may comprise a covering layer, such as a paint, preferably for increasing its corrosion resistance. The connecting device may comprise an anodic layer, such as aluminium oxide, for increasing its corrosion resistance. In non-limiting examples, the anodic layer has a thickness of 5-25 μm, preferably 10-20 μm.

Next, characteristics of lips, including the first and second lips, are described. It is emphasized that the embodiments below may be applied to any or all of the first and second lips in the first and second side portions of any board. By lip is meant a portion of a board protruding in the transverse direction and having a longitudinal extension. The transverse direction is preferably directed outwards, away from the board. Preferably, the lip has a constant transverse cross-section along the longitudinal direction of the side portion.

The first lip and the second lip of each of the first and the second boards may extend at least along a portion of a longitudinal side edge of each board, preferably side by side and preferably along the entire longitudinal side edge of each board.

According to a preferred embodiment, the second lip protrudes beyond the first lip along the entire longitudinal extension of the board. A maximal extension of the second lip in the transverse direction may be larger than a maximal extension of the first lip in the transverse direction of the board.

The lip may comprise an inner wall, an outer wall, and a side wall. According to one embodiment, at least one of the inner wall, the outer wall, and the side wall is flat. According to one embodiment, at least one of the inner wall, the outer wall, and the side wall is curved.

The first lip of the second board may comprise a bevel or rounded portion for simplifying the insertion of the connecting device.

A thickness, preferably a maximal thickness, of the second lip may be larger than a thickness, preferably a maximal thickness, of the first lip.

A thickness, preferably a maximal thickness, of the second lip may be at least 45%, preferably at least 60%, of a thickness, preferably a maximal thickness, of the board. The first lip of the second board preferably engages with the support element in the installed state, possibly via an elevation element arranged in between.

The first lip of the first board and the second lip of the second board may be provided at a first vertical level, and the second lip of the first board and the first lip of the second board may be provided at a second vertical level, wherein the first and second vertical levels are perpendicular distances from the support element. By way of example, a transversely outer portion, or a vertical centre portion, of each of the first and second lips above may be provided at the first or second vertical level.

In accordance with the first aspect of the inventive concept, there is a vertical gap in the vertically locked state. The portion of the second lip of the first board and the second board may be an upper and transversely outer portion of the second lip and a lower and transversely outer portion of the second lip, respectively.

In an installed state, there may be a horizontal space between the second lip of the first board and the first lip of the second board. This horizontal space may be the same as the horizontal space between the first lip of the first board and the second lip of the second board, especially when the boards are rotationally symmetric by 180 degrees as described above and below. By having the horizontal spaces and the vertical gap, there may be a continuous path between the boards, from a top part to a bottom part of the boards, which may be advantageous for ventilational purposes.

The vertical gap may be provided at least in a region between a first and a second vertical plane. In a first example, the first vertical plane is provided in the side wall of the second lip of the first board and the second vertical plane is provided in the side wall of the second lip of the second board. In a second example, the first vertical plane is provided in the side wall of the first lip of the first board and the second vertical plane is provided in the side wall of the first lip of the second board. The vertical gap may be provided at least in a vertical plane located between the first vertical plane and the second vertical plane, e.g. in the middle. The vertical gap preferably also extends in the horizontal directions.

Transversely outer portions of the first and second lips of the first and second boards, respectively, may be horizontally separated by a space. The horizontal space may be provided in the first horizontal plane.

Optionally, in an installed state, there may be provided an elevation element under at least a portion of the second board for vertically elevating the second board to a vertical level of the first board. Thereby, the front sides of the first and second board may be provided at the same vertical level. This may also be achieved by providing a depression in the first board at the location of the connecting device.

According to one embodiment, at least a portion of each of the first and the second decking boards is symmetric under a 180 degrees rotation around a longitudinal axis of the decking board. The portion may be a portion of the board configured to engage with the connecting device, e.g. provided in the first and/or second lip(s). An advantage of this embodiment is that any of the first and second surface members may be used as a visible surface member. In particular, the surface member having the most attractive properties, such as aesthetics or physical characteristics, may be chosen—during installation or after a period of time.

Additionally, individual boards may be more easily handled during installation. Indeed, only a single rotation around the longitudinal axis is needed for changing the visible surface member of the board, without any further rotation. This is particularly advantageous when the board has a large longitudinal extension when it may be cumbersome to rotate the board around a transverse axis, such as in a small space.

The entire first and second boards may be symmetric, or substantially symmetric, under the 180 degrees rotation around the longitudinal axis.

According to one embodiment, an inner wall of the second lip of the first decking board is inclined with respect to the surface member of the first decking board or curved. An advantage of this embodiment is that fluids, such as water, and moist may be efficiently drained off from the board. The second lip may be tapering along the transverse direction outwards. The inclined inner wall may be planar. The curvature of the curved inner wall may be convex or concave.

An inner wall of the second lip of each of the first and second boards may be inclined with respect to the respective surface members.

An inner wall of the second lip in the second side portion of the first board may be inclined with respect to the surface member of the first board. The inclination may be the same as for the inner wall of the second lip in the first side portion. Thereby, the first board may be made symmetric under a 180 degrees rotation around its longitudinal axis while keeping the drainage advantage described above.

According to one embodiment, the connecting device is provided in a first groove of the first decking board in the vertically locked state and/or the connecting device is provided in a second groove of the second decking board in the vertically locked state. By this embodiments, the connecting device may be more firmly connected to the first and/or second board. The first groove may be provided between the first and second lip of the first board. The first groove may be provided substantially halfway between the first and the second surface member. The second groove may be provided between the first and second lip of the second board. The second groove may be provided substantially halfway between the first and the second surface member.

The connecting device may engage with a lower groove wall of the first groove. The lower groove wall may be the same wall as the inner wall of the second lip. The connecting device may engage with a lower groove wall of the first groove. The lower groove wall may be the same wall as the inner wall of the first lip of the second board.

The first and second grooves, in particular portions of the grooves configured to engage with the connecting device, may be provided at different vertical levels.

According to one embodiment, the connecting device engages with the second lip of the first decking board and with the first lip of the second decking board in the vertically locked state. By engaging with the second lip, such as an inclined second lip, a tilting or twisting of the connecting device may be counteracted. The connecting device may engage with at least one of the inner wall, the side wall, and the outer wall of the second lip of the first board. Moreover, the connecting device may engage with at least one of the inner wall, the side wall, and the outer wall of the first lip of the second board.

According to one embodiment, the connecting device is further configured to engage with the support element in the vertically locked state. A portion of the connecting device may be provided between the first board and the support element. Thereby, a tilting or displacement of the connecting device may be counteracted.

The connecting device may be configured to be connected, preferably releasably connected, to the support element, preferably to a joist. Thereby, the first board may be connected to the support element by engaging with the connecting device. By way of example, the first board may engage with the connecting device by means of a press fit, a snap fit, or an attaching element.

The connecting device may at least partially enclose the second lip of the first board while being connected to the support element, preferably enclosing the outer wall and side wall and, optionally, also the inner wall.

The connecting device may be connected to the first and/or the second board in the vertically locked state. The first board may be horizontally locked relative to the connecting device at least in a first transverse direction, optionally also in an opposite second transverse direction.

In one example, the connecting device is fixed to the support element. In another example, the connecting device is displaceable relative to to the support element, preferably in a longitudinal horizontal direction of the support element, such as a joist.

The connecting device may comprise at least one tooth configured to engage with the second lip of the first decking board. By means of the at least one tooth, an improved connection of the connecting device to the first board, and hence of the first board to the support element, may be provided. The at least one tooth may be configured to engage with the second lip by means of a snapping engagement. The second lip of the first board may comprise a notch configured to engage with a tooth in the vertically locked state. The at least one tooth may be configured to be pressed into the material of the second lip. The tooth may be a barb.

According to one embodiment, the connecting device is configured to cooperate with the support element via an attaching element. Thereby, the attaching element may connect the first side portion vertically and/or horizontally to the support element. The connecting device may comprise an opening through which the attaching element may be provided in the installed state.

The connecting device may be accessible and/or operable through the horizontal space so that it may be disconnected from the support element, it may disengage from the boards, etc. Preferably, the horizontal space between the first lip of the first board and the second lip of the second board is at least 1 mm, more preferably at least 5 mm, most preferably at least 10 mm. The space may be such that the attaching element is accessible by a tool from a visible side of the first and second boards in the vertically locked state, in particular by means of a linear displacement of the tool. Thereby, the first and/or second boards may be removed or replaced from above. By way of example, the tool may be a screw driver, a magnet, or similar tools.

According to one embodiment, the attaching element is provided through the second lip of the first decking board and through the connecting device. Thereby, displacements of the first board caused by temperature and/or moisture variations may be counteracted. For example, a displacement of the board along its horizontal transverse direction may be counteracted. Typically, a wood-based board expands or contracts along the horizontal transverse direction under the influence of moisture variations. Also, longitudinal displacements of the board may be counteracted. Typically, a WPC board expands or contracts in the horizontal transverse direction as well as in the longitudinal direction under the influence of temperature variations.

The connecting device may engage with the second lip of the first board and/or the first lip of the second board with pretension in the installed state.

In an installed state, there may be an inner horizontal separation between the connecting device and a third wall of a groove connecting the lower and upper groove walls. Thereby, the connecting device may be displaced in the groove under temperature and/or moisture variations. In non-limiting examples, the inner separation may be 0.1-2 mm for WPC boards and 2-8 mm, preferably more than 6 mm, for boards made of softwood.

The second side portion may be displaceable in the horizontal longitudinal and/or transverse direction in the vertically locked state. As a result, stress forces on the connecting system caused by various displacements of the boards may be reduced.

The displacements may be induced by local or global strains of the boards, temperature fluctuations, moisture or humidity variations, etc.

In one embodiment, the connecting device and boards are arranged to connect the first board transversely relative to the connecting device by a first retaining force, and to connect the second board transversely relative to the connecting device by a second retaining force. The first retaining force may be larger than the second retaining force. Thereby, the second side portion may be horizontally displaced more easily than the first side portion and may reduce stress forces during temperature and/or moisture variations. Alternatively, the second retaining force may be larger than the first retaining force. In non-restrictive examples, the larger retaining force may be between 0.5 and 2.0 kN/m and the smaller retaining force may be between 0.25 and 1.0 kN/m.

In one embodiment, the attaching element is provided through the second lip of the first board and a portion of the connecting device is arranged between the second lip of the first board and the support element in the vertically locked state. Here, an exact alignment of the connecting device between the board and the support element may not be needed, since the attaching element may be provided outside of, or next to, the connecting device. Moreover, in the vertically locked state the connecting device may be horizontally connected relative to the board by means of pressure of the board from above and/or pressure of the support element from below. Optionally, the connecting device may comprise a fixing portion for further fixation of the connecting device.

According to one embodiment, the connecting device is arranged to lock the first side portion or the second side portion vertically and at least in a first transverse direction, optionally also in an opposite second transverse direction, preferably allowing a displacement of the first and/or second board relative the support element along a longitudinal direction of each board. The connecting device may comprise at least one flange, or similarly, functioning as an attaching element. The connecting device may be arranged to cooperate, preferably engage, with the second lip of the first board and the first lip of the second board. The engagement may be pretensioned. The at least one tooth may be provided on the flange being an attaching element.

According to one embodiment, the set of decking boards further comprises the attaching element, wherein a maximal transverse extension of the attaching element is essentially the same or smaller than the horizontal space. A longitudinal extension of the attaching element preferably is larger than the transverse extension. By means of this embodiment, the attaching element may be removed, even in the installed state of the set and, thereby, a board may be removed and replaced. The maximal transverse extension may be a width of the attaching element, such as a width of a head of a screw. By being "essentially the same", the attaching element may be removed even when the maximal transverse extension is larger than the horizontal space, e.g. by tilting the attaching element with respect to the side walls of the lips or by compressing the material of the lips and forcing out the attaching element.

In one embodiment, the connecting device is configured to be rotated for vertically locking the second board with respect to the first board. An advantage of this embodiment is that the connecting device may be removed in a simpler manner. The connecting device, preferably the first engagement portion, may comprise a retaining element. The retaining element may be configured to counteract twisting of the connecting device during installation, in particular when an attaching element is driven or turned into the support element through the second lip. The retaining element may also improve the connection of the connecting device to the second lip. The retaining element may be provided inside or outside of the opening or hole in the longitudinal direction of the first engagement portion. In a non-limiting example, the retaining element is a sharp retaining element, such as a jag or a spike. The sharp retaining element may be configured to be inserted or pressed into a portion of the second lip, e.g. the inner wall.

An underside of the second engagement portion may be rounded. Thereby, the installation of the connecting device may be simplified and the second board may be displaced more easily, especially along a longitudinal direction.

According to one embodiment, the second board further comprises a first side portion being opposite to the second side portion of the second board and extending along the longitudinal direction of the second board, wherein the first side portion comprises: a first lip and a second lip, wherein an extension of the second lip in a transverse direction of the second board is larger than an extension of the first lip in the transverse direction of the second board, wherein the second board is configured to be connected to the support element, and wherein a third board is configured to assume a vertically locked state with respect to the second board in which a second connecting device cooperates with the second and third boards. By means of this embodiment, the second connecting device may vertically lock a third board to the second board in complete analogy with the discussion above.

A shape of the side wall of the first lip of the first board may be the same as or complementary to a shape of the side wall of the second lip of the second board. By a complementary shape of a first wall and a second wall is here meant that a protruding or convex portion of the first wall has a corresponding recess or concave portion of the second wall, and vice versa. Moreover, a shape of the side wall of the second lip of the first board may be same as or complementary to a shape of the side wall of the first lip of the second board. In a first example, the side walls are vertical. In a second example, the side walls are inclined with respect to a perpendicular direction of a surface member. Thereby, the connecting device may be more easily accessed and manipulated when the inner wall of the second lip of the first board is inclined. In a third example, the side walls are curved.

Corresponding same or complementary shapes as above may be provided for the side wall of the second lip of the first board and the side wall of the first lip of the second board. It is also clear that these shapes may be provided on an individual board, i.e. the side wall of the first and second lip of the opposed side portion may be the same as or may be complementary to the side wall of the second and first lip, respectively, of the side portion.

In a non-limiting example, at least a portion of the side wall of the first lip of the first board is perpendicular to at least a portion of the, preferably inclined, inner wall of the second lip of the first board.

According to one embodiment, the portion of the second lip of the second decking board is provided above the portion of the second lip of the first decking board in the vertically locked state such that they form a horizontal overlap. By means of the horizontal overlap, at least a portion of the second lip may be concealed in an installed state. Also the connecting device and/or attaching element may be partly or even completely concealed.

The horizontal overlap may be an overlap between a projection of the portion of the second lip of the second board and a projection of the portion of the second lip of the first board onto a horizontal plane, such as, the first or the second horizontal plane.

The connecting device may comprise a protrusion configured to be pressed into, or to be disposed in a notch of, the second lip of the first decking board in an installed state.

A portion of the connecting device may be configured to be provided in a recess, preferably in an inner wall and/or a side wall, of the second lip of the first decking board in an installed state.

Preferably, the boards are installed in a condition such that the level of deformation of the boards over time is kept low or at a minimum. Preferably, the boards are sufficiently dried and/or adapted to the installation environment, e.g. regarding temperature, before installing them. According to one embodiment, however, the boards are configured to be installed with the first lip of the first board and the second lip of the second board being in abutment with each other, whereby the horizontal space between them is formed over time as the material of the boards changes volume, in particular decreases, e.g. due to shrinkage. The material may be a hygroscopic material and/or a material being susceptible to thermal expansion/contraction. Moreover, the material may be an impregnated and/or pressure-treated material. For example, the boards may comprise softwood or may be WPC boards.

According to a second aspect of the inventive concept, there is provided a connecting device for connecting decking boards comprising: a first engagement portion configured to engage with a second lip of a first decking board, optionally comprising a hole for connecting the connecting device to a support element with an attaching element through the hole and the second lip, a second engagement portion configured to engage with a first lip of a second decking board, optionally comprising an end section being curved or forming an angle with respect to an overall lengthwise extension of the second engagement portion.

The connecting device may further comprise a third segment configured to engage with a side wall of the second lip and preferably arranged at an angle with respect to the second engagement portion, such as 45°-135°, preferably 90°.

A portion, preferably an inner section, of the first engagement portion may be inclined with respect to a portion, preferably an inner section, of the second engagement portion.

An end section of the first engagement portion may be parallel to the portion of the second engagement portion.

The hole may be provided in the portion of the first engagement portion.

The first engagement portion and the second engagement portion may be provided asymmetrically with respect to the third segment.

A support surface of the first engagement portion may be vertically displaced from a support surface of the second engagement portion. The support surface of the first engagement portion may be vertically displaced farther away from an end point of a third segment than the support surface of the second engagement portion is, the third segment being configured to engage with a side wall of the second lip.

The connecting device may further comprise a protrusion configured to be disposed in a notch of the second lip of the first decking board in an installed state.

The connecting device may further comprise a protrusion configured to be pressed into the second lip of the first decking board in an installed state.

The hole may be circular.

One or several of a support surface of the first engagement portion, an inner section of the first engagement portion, and a third segment of the connecting device, may be configured to guide the connecting device into position and/or to counteract twisting or tilting of the connecting device during installation The set of decking boards in accordance with the first aspect may comprise the connecting device in accordance any of the embodiments of the second aspect.

According to a third aspect of the inventive concept, there is provided a method of demounting a set of decking boards comprising a first connecting device cooperating with a first and a second decking board, and a second connecting device cooperating with the second and a third decking board. The method comprises:

vertically unlocking the second decking board with respect to the first decking board;

disconnecting the second decking board from a support element, preferably by releasing a horizontal relative connection between the second connecting device and the second decking board; and removing the second decking board.

The act of releasing a horizontal relative connection between the first connecting device and the first decking board may comprise removing a first attaching element provided through the second lip of the first decking board, the first attaching element being provided through or outside of the first connecting device.

The act of releasing a horizontal relative connection between the second connecting device and the second decking board may comprise removing a second attaching element provided through the second lip of the second decking board, the second attaching element being provided through or outside of the second connecting device.

The act of vertically unlocking the second decking board with respect to the first decking board may comprise: releasing a horizontal relative connection between the first connecting device and the first decking board, displacing the second decking board horizontally towards the third decking board, or angling the first and second decking boards away from the support element, preferably while releasing a horizontal relative connection between the first connecting device and the first decking board.

The horizontal relative connection between the first connecting device and the first decking board may comprise an engagement between a fixing portion of the first connecting device and the first decking board, and the horizontal relative connection between the second connecting device and the second decking board may comprise an engagement between a fixing portion of the second connecting device and the second decking board.

The horizontal relative connection between the second connecting device and the second board may be released by operating and/or accessing the second connecting device through a horizontal space provided between a first lip of the second board and a second lip of the third board.

The horizontal relative connection between the first connecting device and the first decking board may be released by operating and/or accessing the first connecting device through a horizontal space provided between a first lip of the first decking board and a second lip of the second decking board.

It is clear that the order of the method steps presented in any of the embodiments above are non-limiting and that the steps may be performed in any order, or even simultaneously.

Embodiments of the first, second and third boards and of the connecting device are largely analogous to those of the first and second aspects wherein reference is made to the above.

Other aspects of the inventive concept and embodiments of the first, second and third aspects are provided in an embodiment section below.

BRIEF DESCRIPTION OF THE DRAWINGS

The disclosure will in the following be described in connection to exemplary embodiments and in greater detail with reference to the appended exemplary drawings, wherein:

FIGS. 14*a-e* illustrate methods of demounting a decking board using connecting devices in accordance with any of the embodiments in FIGS. 8*a-h*.

DETAILED DESCRIPTION

Next, embodiments of decking boards will be described with reference to FIGS. 1, 2 and 3*a-h*.

Figure 1:
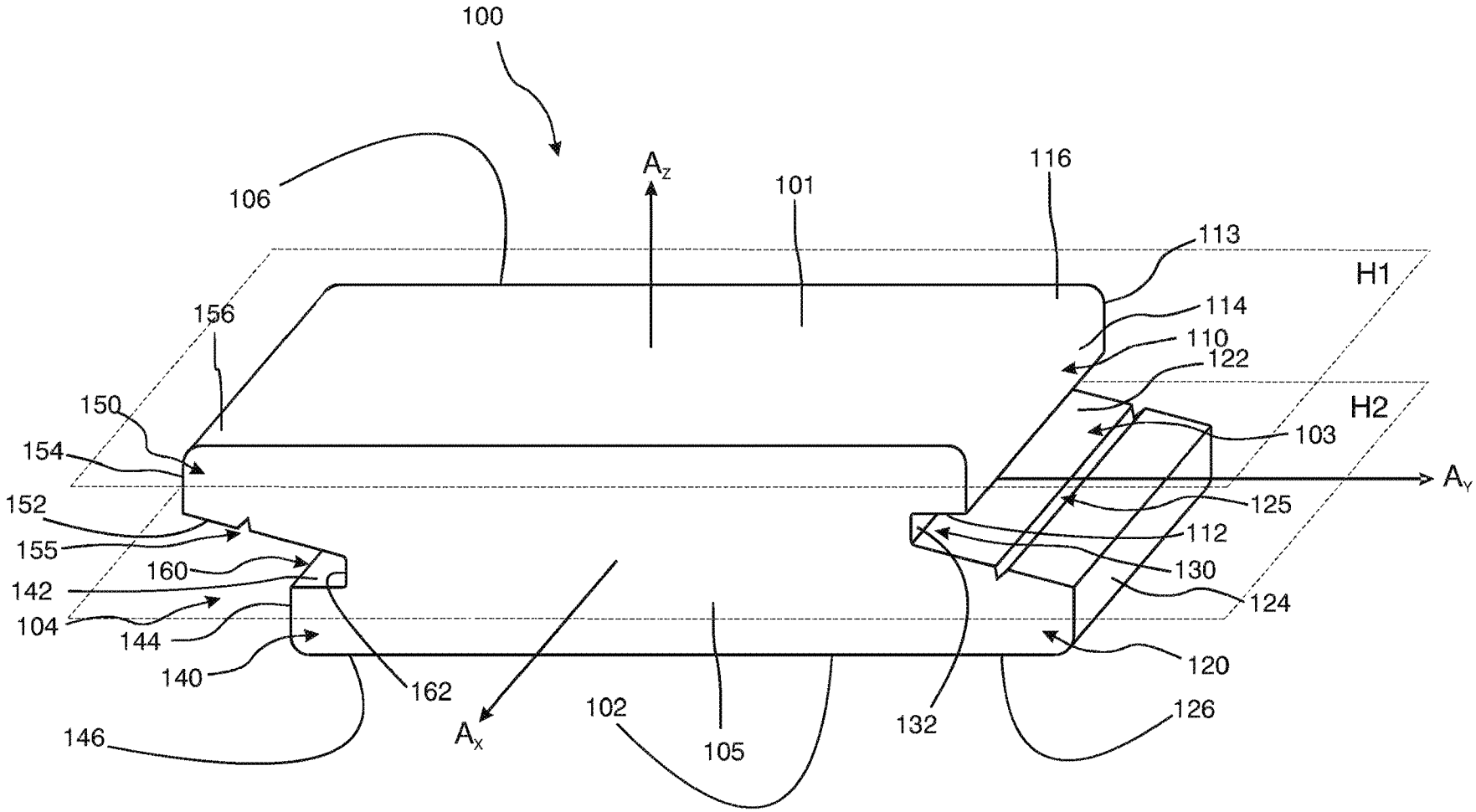
FIG. 1 illustrates a perspective view of a decking board according to an embodiment.

For illustrative purposes FIG. 1 shows a perspective view of a section of an individual decking board 100 according to one embodiment. It is clear that a longitudinal extension of the board may be much larger than a horizontal transverse extension of the board. The board has the maximal horizontal dimensions 145 mm×4000 mm and a maximal thickness of 34 mm, but clearly other dimensions are equally conceivable, e.g. 50-500 mm×500-6000 mm×10-50 mm. The board is made of softwood, preferably having a thickness at least about 30 mm, but other materials are possible. For example, it may be a WPC board. Preferably, the softwood board is impregnated and pressure treated. Where applicable, the board is preferably installed such that the annual rings are curved upwards, but a curvature downwards is also conceivable.

For orientation, a right-handed coordinate system spanned by three perpendicular axes ($A_X$, $A_Y$, $A_Z$) is indicated in FIG. 1. The board comprises a first surface member 101 and a second surface member 102 that are substantially parallel to each other. The first and second surface members are planar. A centre portion of the board 100 has a substantially constant thickness along the longitudinal direction of the board, indicated by the axis $A_X$ in FIG. 1. Moreover, the board comprises a first pair of longitudinal side edges 103, 104 provided along the longitudinal direction of the board, and a second pair of, preferably flat, side edges 105, 106 provided along the short edges and extending along a horizontal transverse direction of the board, indicated by the axis $A_Y$, and along a direction perpendicular to the first surface member 101, indicated by the axis $A_Z$.

The first longitudinal side edge 103 comprises a first 110 and a second 120 lip. The second lip protrudes with respect to the first lip so that a maximal extension of the second lip is larger than a maximal extension of the first lip along the transverse axis $A_Y$. A first groove 130 is provided between the first and second lip.

The first lip 110 comprises an inner wall 112, a side wall 114, and an outer wall 116. The outer wall 116 is provided as a portion of the first surface member 101. The inner wall 112 is provided as an upper groove wall of the first groove 130. The side wall 114 connects the inner 112 and outer 116 wall. The inner 112 and outer 116 walls are parallel to each other.

The second lip 120 comprises an inner wall 122, a side wall 124, and an outer wall 126. The outer wall 126 is provided as a portion of the second surface member 102. The inner wall 122 is provided as a lower groove wall of the first groove 130. The side wall 124 connects the inner 122 and outer 126 wall. The inner wall 122 is inclined with respect to the outer wall 126. A width of the second lip 120 in a thickness direction along the axis $A_Z$ in FIG. 1 decreases along $A_Y$ towards an end of the first longitudinal side edge 103.

The first groove 130 comprises a third wall 132 connecting the inner walls 112 and 122. The third wall 132 is provided perpendicularly to the first 101 and second 102 surface members.

The second longitudinal side edge 104 comprises a first 140 and a second 150 lip. The second lip 150 protrudes with respect to the first lip 140 so that a maximal extension of the second lip 150 is larger than a maximal extension of the first lip 140 along the transverse axis $A_Y$. A second groove 160 is provided between the first 140 and second 150 lip.

The first lip 110 and the second lip 150 are provided in a first horizontal plane H1. Moreover, the second lip 120 and the first lip 140 are provided in a second horizontal plane H2. The first horizontal plane H1 and the second horizontal plane H2 are parallel with the first surface member 101 as well as with the second surface member 102.

The first lip 140 comprises an inner wall 142, a side wall 144, and an outer wall 146. The outer wall 146 is provided as a portion of the second surface member 102. The inner wall 142 is provided as a lower groove wall of the second groove 160. The side wall 144 connects the inner 142 and outer 146 wall. The inner 142 and outer 146 walls are parallel to each other.

The second lip 150 comprises an inner wall 152, a side wall 154, and an outer wall 156. The outer wall 156 is provided as a portion of the first surface member 101. The inner wall 152 is provided as an upper groove wall of the second groove 160. The side wall 154 connects the inner 152 and outer 156 wall. The inner wall 152 is inclined with respect to the outer wall 156. A width of the second lip 150 in a thickness direction along the axis $A_Z$ in FIG. 1 decreases along $A_Y$ towards an end of the second side edge 104.

The second groove 160 comprises a third wall 162 connecting the inner walls 142 and 152. The third wall 162 is provided perpendicularly to the first 101 and second 102 surface members.

The walls 112, 114, 116 and 142, 144, 146 of the first lips and the walls 122, 124, 126 and 152, 154, 156 of the second lips are flat. Preferably, there is a bevel or smooth transition between the walls 114 and 116, between the walls 124 and 126, between the walls 144 and 146, and between the walls 154 and 156. Moreover, the side walls 114, 124, 144 and 154 are arranged perpendicularly to the first surface member 101.

A respective notch 125 and 155 is provided in the second lips 120 and 150, preferably extending along the entire side edges 103, 104. The notches 125, 155 are provided in the inner walls 122, 152.

According to the embodiment in FIG. 1, the board is symmetric under a rotation by 180 degrees around the axis $A_X$. For example, the positions of the side wall 114 and the side wall 144 are interchanged after the rotation. Thereby, the maximal transverse extensions of the first lips 110 and 140, and of the second lips 120 and 150, along the axis $A_Y$ are essentially the same.

Due to the discrete rotational symmetry of order two as described above, the board 100 may be installed with either of the first 101 and second 102 surface members facing upwards so that it becomes visible. For sake of clarity, it is assumed that the first surface member 101 is visible after installation of the board 100, i.e. facing upwards, but it is clear that this choice is non-limiting.

Figure 2:
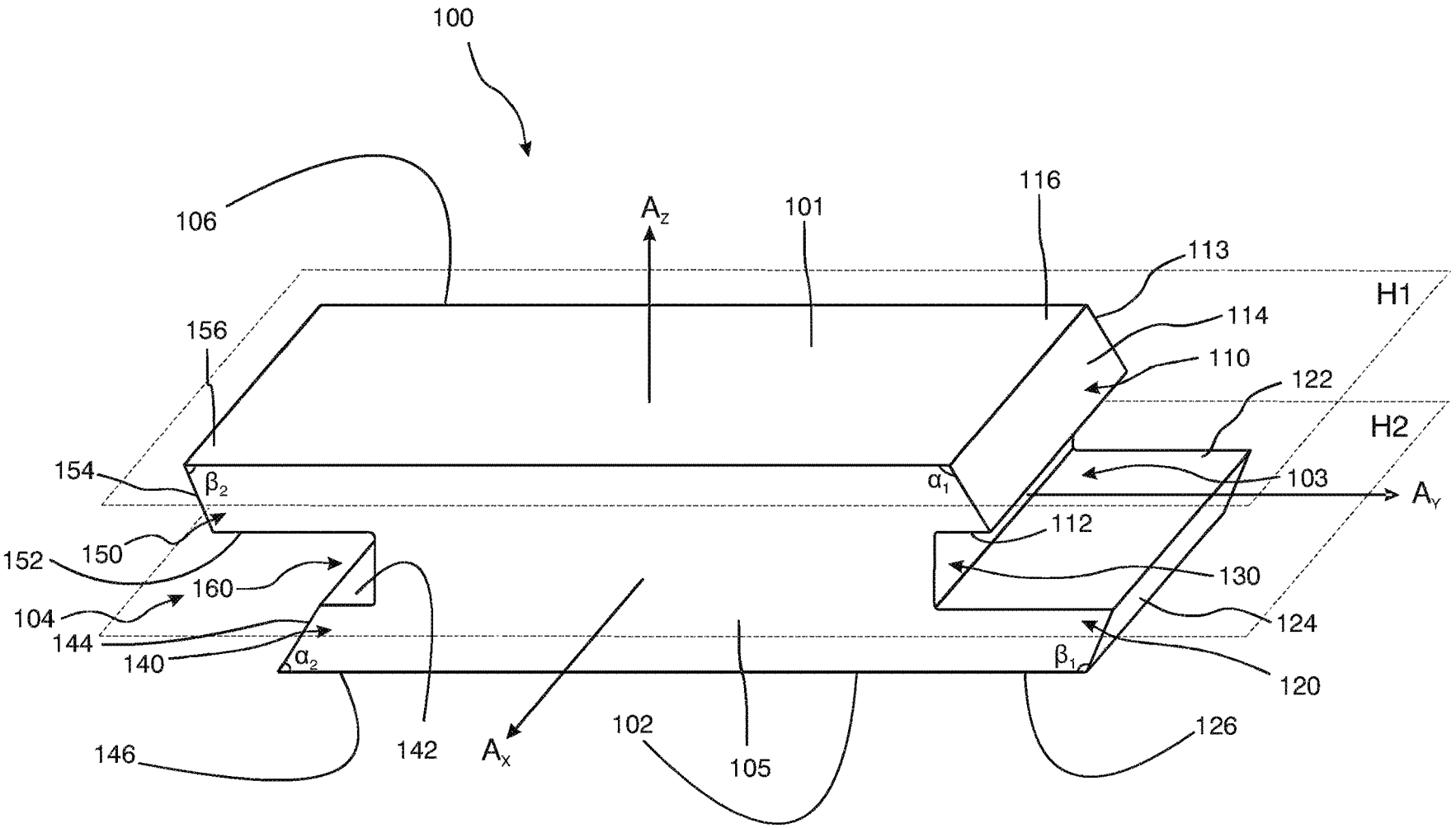
FIG. 2 illustrates a perspective view of a decking board according to an embodiment.

FIG. 2 illustrates a perspective view of a section of an individual decking board 100 according to another embodiment. The embodiment in FIG. 2 is largely analogous to the embodiment in FIG. 1 whereby reference is made to the above. However, in FIG. 2 the side walls 114 and 124 are inclined with respect to the first 101 and second 102 surface members, respectively, by an angle $\alpha_1$ and $\beta_1$, respectively. In non-restrictive examples, the angles $\alpha_1$ and ft may be obtuse, e.g. between 90° and 140°, more preferably between 100° and 120°. The angles $\alpha_1$ and $\beta_1$ may also be acute, e.g. between 40° and 90°, more preferably between 60° and 80°. The side walls 144 and 154 are also inclined with respect to the second 102 and first 101 surface members, respectively, by an angle $\alpha_2$ and $\beta_2$, respectively. The non-restrictive examples above regarding $\alpha_1$ and $\beta_1$ are also valid for $\alpha_2$ and $\beta_2$.

In one example, $\beta_2$ is different from $\beta_1$ and/or $\alpha_2$ is different from $\alpha_1$. In another example, $\beta_2$ is the same as $\beta_1$ and $\alpha_2$ is the same as $\alpha_1$. In the latter example, the board is symmetric under a rotation by 180 degrees around the axis $A_X$ (not shown). For example, the positions of the side walls 114 and 144 are interchanged.

Next, various installed states of two or more boards of the types in FIG. 1 or 2 will be described. In particular, the board 100 may be a first 100*a* or a second 100*b* board. In the installed state, the first board is connected to a support element 300 and the second board is vertically locked to the first board. The second board is further connected to the support element. Additional boards may be connected to the first and second boards in a similar manner.

FIGS. 3*a-f* illustrate different embodiments of side portions in a junction area of a first 100*a* and a second 100*b* board as seen in side views or in transverse cross-sections. It is understood that the first and second boards preferably comprises an opposed side portion as in FIGS. 1 and 2 with the same shape as the side portion of the second and first board, respectively.

For clarity, embodiments of connections of the boards to the support element and vertical locking of the second board 100*b* to the first board 100*a* are suppressed in FIGS. 3*a-h*. These will be described further below and any of those may be used in conjunction with any of the shapes in FIGS. 3*a-h*.

Figure 3A:
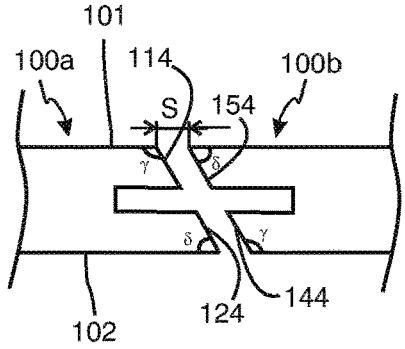
FIGS. 3*a-h* illustrate embodiments of side portions of the boards in FIG. 1 or 2 as seen in side views or in transverse cross-sections.
Figure 3B:
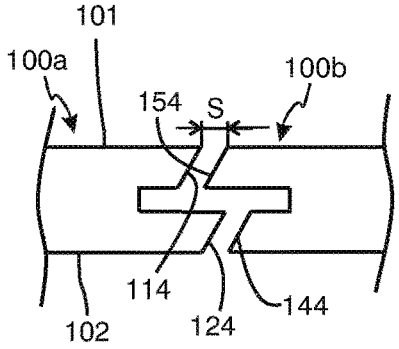
Figure 3C:
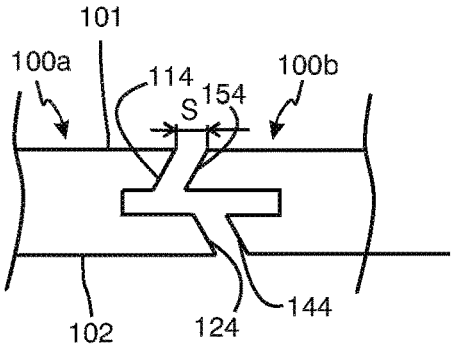

FIGS. 3*a-c* illustrate different embodiments wherein the side walls 114, 154 and 124, 144 of the first 100*a* and second 100*b* boards are flat and inclined with respect to the first 101 and second 102 surface members, respectively. An angle γ between the first surface member 101 and the side wall 114 may be obtuse as in FIG. 3*a*, e.g. 90°≤γ≤135°, or acute as in FIGS. 3*b* and 3*c*, e.g. 45°≤γ≤90°, and an angle δ between the second surface member 102 and the side wall 124 may be acute, e.g. 45°≤δ≤90°, as in FIGS. 3*a* and 3*c* or obtuse, e.g. 90°≤δ≤135°, as in FIG. 3*b*. In the embodiments in FIGS. 3*a-c*, the inclinations of the side walls 144 and 154 with respect to the second 102 and first 101 surface members, respectively, of the second board 100*b* are the same as the inclinations of the side walls 114 and 124, respectively.

Figure 3D:
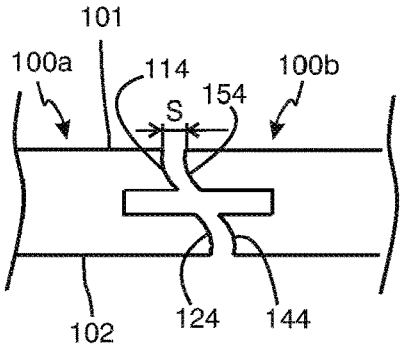
Figure 3E:
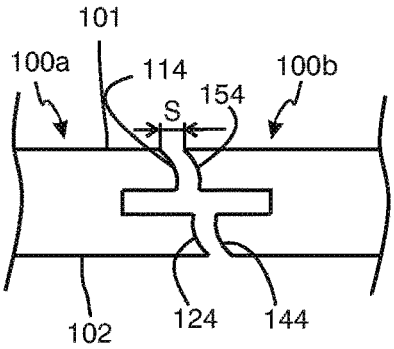

FIGS. 3*d-e* illustrate embodiments wherein the side walls 114, 124, 144 and 154 are curved. The curvature of the side walls 114 and 144 may be concave as in FIG. 3*d* or convex as in FIG. 3*e*. The curvature of the side walls 124 and 154 may be convex as in FIG. 3*d* or concave as in FIG. 3*e*. Any other combination of these embodiments is possible.

Figure 3F:
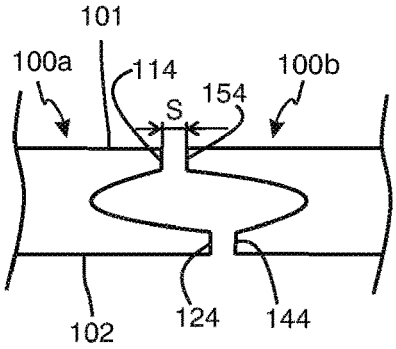

FIG. 3*f* illustrates an embodiment wherein the walls 112, 132 and 122 each are curved and smoothly connected to each other. Likewise, the walls 142, 162 and 152 are each curved and smoothly connected to each other.

Figure 3G:
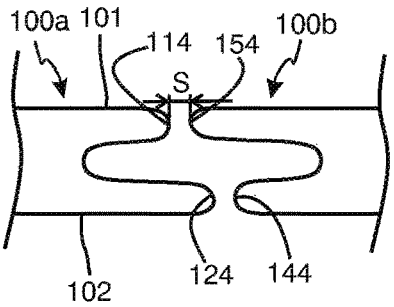

In FIG. 3*g* there is illustrated an embodiment wherein the side walls 114 and 124 are smoothly connected to the first 101 and second 102 surface members, respectively, and wherein the side walls 144 and 154 of the second longitudinal side edge 104 are smoothly connected to the first 101 and second 102 surface members, respectively. By smooth is here meant that the transition is rounded or curved.

Figure 3H:
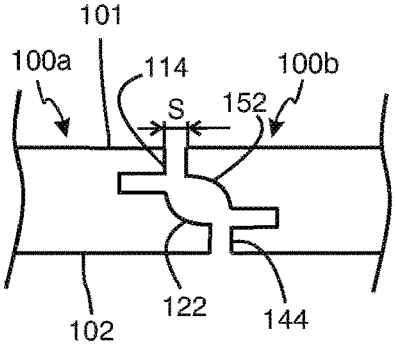

FIG. 3*h* illustrates curved inner walls 122 and 152. By means of the curved inner walls 122, 152, fluids, such as water, e.g. rain water, may be more efficiently drained from the boards. Here, an outer portion of each of the inner walls is concavely curved. It is understood that an inner portion of the inner walls, or even the entire inner walls, may be curved: concavely or convexly.

In FIGS. 3*a-g*, the groove 130 of the first board 100*a* is arranged in the middle between the first 101 and second 102 surface members. In FIG. 3*h* the groove 130 is closer to the first surface member than to the second surface member and, hence, the groove 160 is closer to the second surface member than to the first surface member of the board. This may be the case in any of the embodiments of the present disclosure.

In any of the embodiments in FIGS. 2 and 3*a-h* there may be a bevel or smooth transition between the walls 114 and 116, 124 and 126, 144 and 146, and 154 and 156 as described above.

The boards 100 are configured to be connected to each other by means of a connecting device 200. FIGS. 4*a-d* illustrate embodiments of a connecting device 200 in perspective views, wherein each comprises a first engagement portion 210, an intermediate portion 220, and a second engagement portion 230. The first engagement portion and/or the intermediate portion are configured to engage with a first board 100*a* and the second engagement portion and/or the intermediate portion are configured to engage with a second board 100*b* in an installed state of the boards.

Figure 4A:
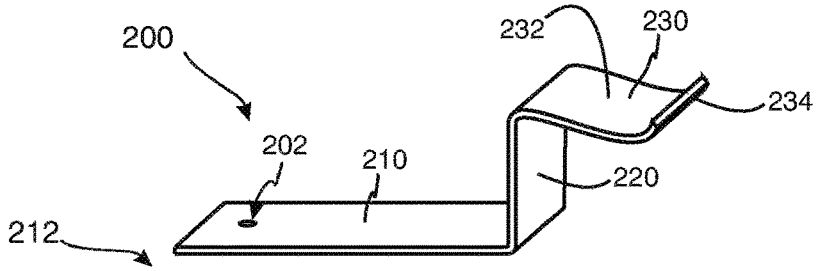
FIGS. 4*a-d* illustrate embodiments of the connecting device in perspective views.

According to the embodiment in FIG. 4*a*, the planar first engagement portion 210 is configured to engage with a portion of the second surface member 102 of the first board 100*a* and the second engagement portion 230 is configured to engage with a portion of the inner wall 142 of the second board 100*b* in the installed state. The intermediate portion 220 connects the first and second engagement portions. A hole 202 is provided in the first engagement portion. The intermediate portion 220 is arranged perpendicularly to the first engagement portion 210.

The second engagement portion comprises a first 232 and a second 234 section. The first section 232 is arranged at an angle with respect to the intermediate portion 220, for example 45°-135°, preferably 70°-85°. The second section 234 is an end section of the second engagement portion that is curved upwards. An underside of the second section comprises a bevel or a rounded portion.

Figure 4B:
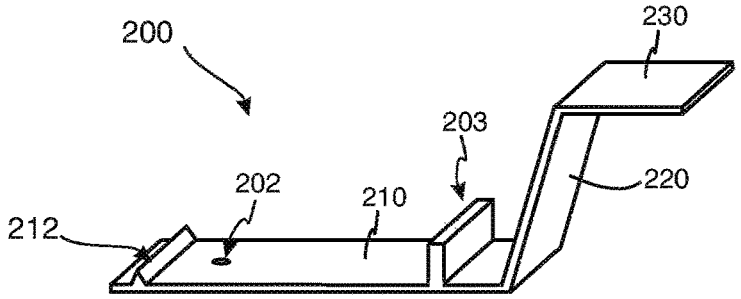

The connecting device 200 in FIG. 4*b* is similar to the one in FIG. 4*a*, except that the intermediate portion 220 is arranged at an angle with respect to the first engagement portion 210. For example, the angle may be 45°-135°, preferably 95°-110°. Moreover, the second engagement portion 230 is planar. Moreover, the first engagement portion 210 comprises a fixing portion 212 configured to improve the fixation of the connecting device to the second surface member. The fixing portion is provided at an end section of the first engagement portion. The fixing portion 212 is acute and/or sharp. The fixing portion may also assume other shapes, e.g. it may be a curved end section.

A shape of at least a portion of the intermediate portion 220 in any of the embodiments of the present disclosure may correspond to a shape of the side wall 124. Thereby, a tight abutment between the intermediate portion and the side wall 124 may be obtained. The intermediate portion may be a flat or a curved surface, for example corresponding to a shape of the side wall 124 in any of the embodiments in FIGS. 1, 2, 3*a-h*.

In any of the embodiments of the present disclosure the connecting device 200 may comprise a positioning portion or spacer 203. Thereby, a uniform gap between the boards may be provided. In FIG. 4*a* the intermediate portion 220 may serve as a positioning portion if it abuts the second lip in the installed state, especially if the second engagement portion 230 is fully inserted into a groove of an adjacent board, see below. In FIG. 4*b* the positioning portion 203 extends vertically upwards from the first engagement portion 210. A shape of at least a portion, such as a wall, of the positioning portion 203 may correspond to a shape of a portion of the side wall 124.

Figure 4C:
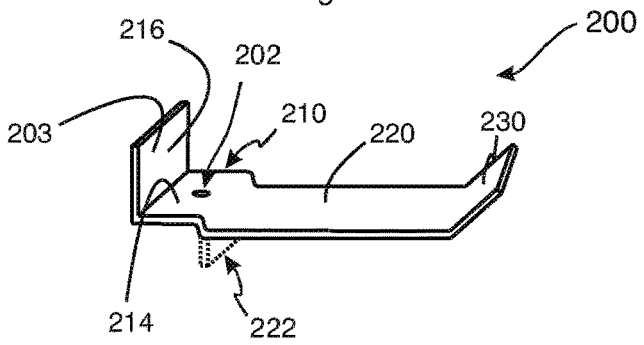

The connecting device 200 in FIG. 4*c* comprises a first engagement portion 210 comprising a first segment 214 and a second segment 216 arranged at an angle with respect to the first segment. The second segment is provided perpendicularly to the first segment, but other angles are possible, e.g. 45°-135°. The first and second segments are flat. The first and second segments may assume other shapes, such as a curved concave surface, a curved convex surface. The second segment 216 is configured to engage with the side wall 114 of the first board 100*a* in the installed state and preferably has a corresponding shape as at least a portion of it. The second segment 216 may serve as a positioning portion 203 for providing a uniform gap between the boards, especially if the second engagement portion 230 is fully inserted into a groove of an adjacent board.

Optionally, the connecting device may comprise a third segment 222 for further connecting and/or positioning it to the first board. For example, the third segment 222 may counteract twisting of the connecting device during installation of the boards. The third segment 222, indicated by a broken line in FIG. 4*c*, may be configured to engage with the second lip 120 in an installed state, for example with the wall 122 or 124. Optionally, there may be provided an opening, such as a blind hole or a notch, in the second lip 120 into which the third segment may be provided, e.g. by a press fit. The third segment may replace or complement the second segment 216 as a positioning element 203.

Figure 4D:
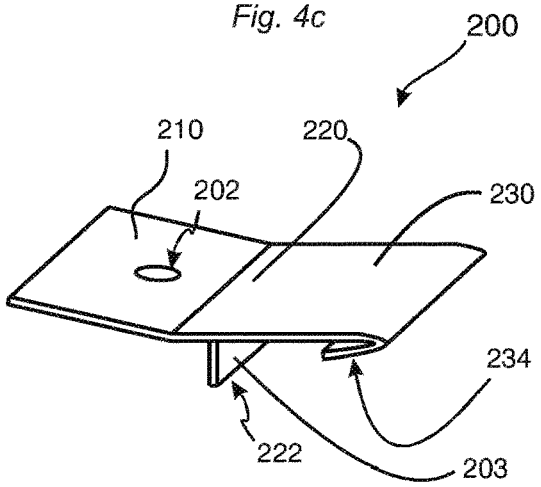

The connecting device 200 in FIG. 4*d* is the same as the one in FIG. 4*c*, but comprising a third segment 222 extending downwards and configured to engage with the side wall 124 of the first board 100*a* in the installed state. The third segment 222 may serve as a positioning portion 203 for providing a uniform gap between the boards. Moreover, the second engagement portion 230 comprises a curved end section 234 that preferably is flexible and preferably accomplishes a pretensioned vertical locking of the second board to the first board. The curved end section 234 comprises a portion that is curved downwards and a portion that extends towards the third segment 222. The third segment 222 is optional and may be omitted.

FIGS. 5*a-d* and FIGS. 6*a-e* illustrate various embodiments of the connecting device 200 as seen in side views in installed states of a first 100*a* and a second 100*b* board provided on a support element 300. It is understood that the boards and the connecting device extend along the longitudinal axis $A_X$, i.e. perpendicularly into the figures. The first board 100*a* is connected to the support element and the second board 100*b* is vertically locked to the first board. The connecting device 200 engages with the first and the second board. The first engagement portion 210 engages with the second surface member 102 and the support element in FIGS. 5*a-d* and 6*d* and with the inner wall 122 in FIGS. 6*a-c* and 6*e*. There is no direct engagement between the connecting device and the support member in FIGS. 6*a-c* and 6*e*. Moreover, the second engagement portion 230 engages with the second groove 160 of the second board 100*b* in FIGS. 5*a-d* and 6*a-e*.

In the installed state, the first lip 110 of the first board and the second lip 150 of the second board are provided in a first horizontal plane H1, and the second lip 120 of the first board and the first lip 140 of the second board are provided in a second horizontal plane H2. The first H1 and second H2 horizontal planes are parallel with the surface members 101, 102 of the first and the second boards. Moreover, there is a transversal horizontal space S between the first lip 110 and the second lip 150.

The spaces S may be measured as distances between transversely outer portions of the lips.

In the installed state, a portion of the second lip 120 is vertically separated from a portion of the second lip 150 by a vertical gap G. According to the embodiments in FIGS. 5*a-d* and 6*a-e*, the vertical gap G is present at least in a region between a first V1 and a second V2 vertical plane. In the non-limiting embodiment in FIG. 5*a*, the first vertical plane V1 is provided in the side wall 124 of the first board and the second vertical plane V2 is provided in the side wall 154 of the second board. In the non-limiting embodiment in FIG. 5*b*, the first vertical plane V1 is provided in the side wall 114 of the first board and the second vertical plane V2 is provided in the side wall 144 of the second board. In non-limiting examples, the space S may be between 5 and 25 mm and the gap G may be between 5 and 15 mm.

The second lips 120 and 150 are partially overlapping along the axes $A_X$ and $A_Y$ in FIGS. 5*a-d* and 6*a-e*. Thereby, at least a part of the inner wall 122 of the first board is concealed from above.

The support element 300 may be any support structure known to a person skilled in the art. It may comprise one or several supporting members. In particular, the support element may be a joist grid system comprising at least one joist, preferably a plurality of joists, such as wood joists or metal joists, e.g. aluminium joists. The support element may also be a sub-flooring, optionally in turn being supported by joists.

Figure 5A:
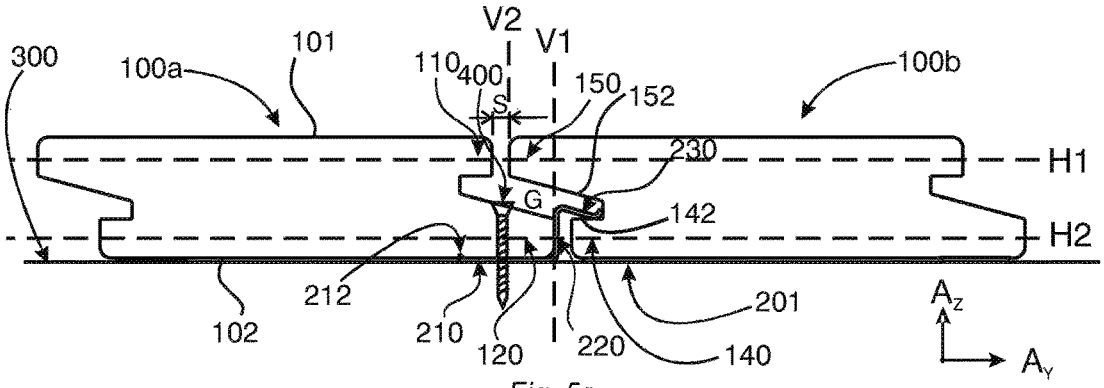
FIGS. 5*a-d* illustrate side views of embodiments of installed decking boards using the connecting devices of the type in FIGS. 4*a-b*.

FIG. 5*a* illustrates an embodiment where the connecting device 200 engages with the first lip 140. A fixing portion 212 of the first engagement portion 210, as in the embodiment in FIG. 4*b*, engages with the second surface member 102 and the intermediate portion 220 engages with the side wall 124 and is shaped in correspondence therewith. The fixing portion 212 may grip into the material of the second surface member. Moreover, the second engagement portion 230 is shaped as in the embodiment in FIG. 4*a* described above and engages with the inner wall 142. The engagement may be pretensioned. Pretension may be obtained by having smaller vertical extension between the support element and a lower part, such as a lowermost portion, of the second engagement portion 230 than a vertical extension (thickness) of the first lip 140, optionally including a vertical extension of an elevation element 201 (see below). The difference between the vertical extensions may be less than 5 mm, preferably less than 1 mm, for example 0.1-0.5 mm.

The first board is connected to the support element 300 by means of an attaching element 400 in the form of a screw that is provided through the second lip 120 and through the hole 202. Thereby, the connecting device 200 becomes horizontally connected relative to the first board. It is clear that other attaching elements are equally conceivable, such as a nail, a bolt, a rivet, a stapler, a flange, a tape, or an adhesive.

Due to the connecting device being arranged under it, the first board is raised vertically. An elevation element 201 is provided under the first lip 140 for raising the second board to the same vertical level as the first board. It is understood that, in one embodiment, a depression may be provided in the first board at the location of the connecting device 200 so that the first board does not become vertically elevated, or only partly elevated, with respect to the support element.

In one embodiment, there is no elevation element 201 and the boards 100*a-b* are slightly inclined, preferably unnoticeable for an observer at a distance therefrom, say at 0.5 m or 1 m. Thereby, the boards may have better drainage properties and may dry faster after being exposed to liquids etc.

Figure 5B:
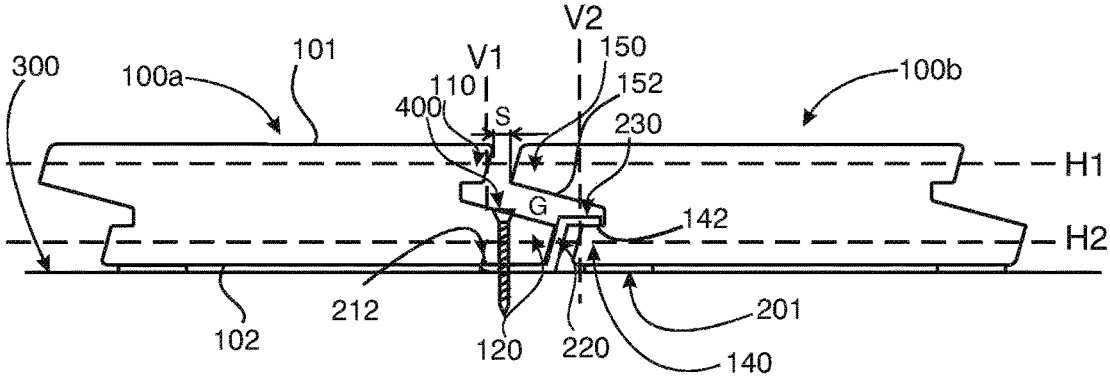

The embodiment in FIG. 5*b* is the same as the embodiment in FIG. 5*a*, except that the fixing portion 212 and the second engagement portion 230 are shaped differently. The fixing portion comprises an acute portion. The second engagement portion is planar and is arranged substantially in parallel with the first engagement portion 210. Moreover, as in FIG. 5*a*, the intermediate portion 220 is shaped as the side wall 124, albeit here being inclined.

Figure 5C:
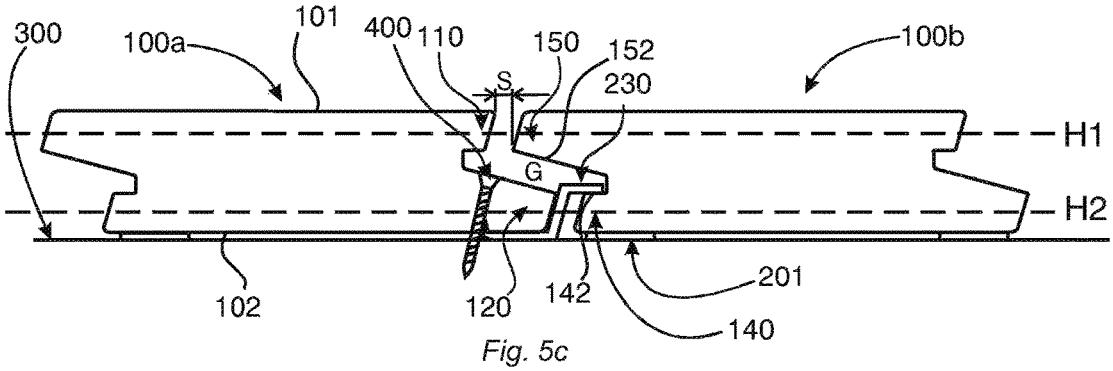

The embodiment in FIG. 5*c* is the same as the embodiment in FIG. 5*b*, except that the attaching element 400 is separated from the connecting device 200. In this case, the connecting device is horizontally connected relative to the first board 100*a* by means of the fixing portion 212 and/or by means of pressure exerted from below and above by the support element 300 and the second lip 120, respectively, when the attaching element is connected to the support element. In one embodiment (not shown), the fixing portion 212 is absent.

Figure 5D:
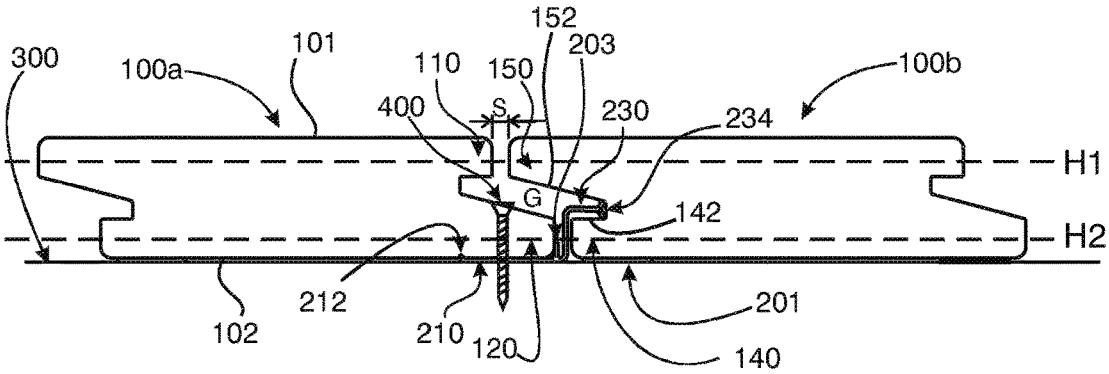

The embodiment in FIG. 5*d* is the same as in the embodiment in FIG. 5*a*, except that the connecting device 200 comprises a positioning portion 203 as described in relation to FIG. 4*b* and the second engagement portion 230 comprises an end section 234 comprising an upper and a lower portion. The upper and lower portions extend along the longitudinal axis $A_X$ and are configured to engage with the inner walls 152 and 142, respectively. The engagement may be an abutment or may be pretensioned. Thereby, the second board may be locked to the first board in an improved manner. In one embodiment (not shown) there is only an upper portion.

Figure 6A:
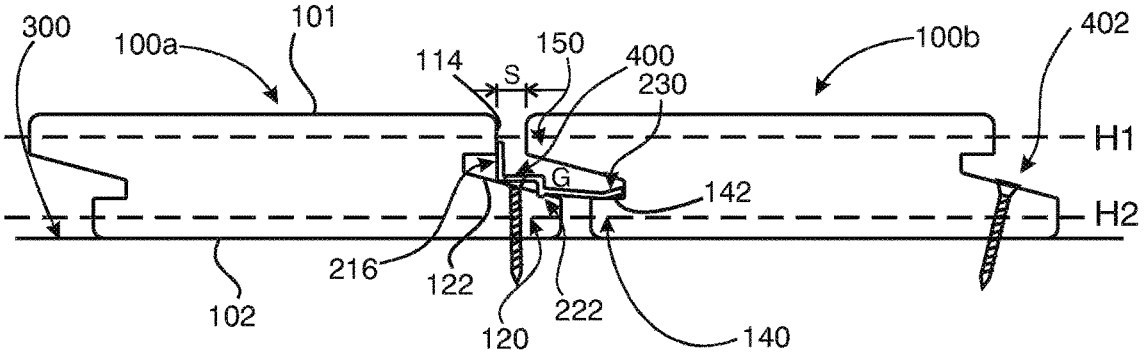
FIGS. 6*a-e* illustrate side views of embodiments of installed decking boards using the connecting devices of the type in FIGS. 4*c-d* and embodiments wherein an adhesive is used for connecting the connecting device.

In FIGS. 6*a-e* the connecting device 200 engages with the second lip 120 from above. FIG. 6*a* illustrates an embodiment in which the connecting device in accordance with FIG. 4*c* described above connects the first and second boards. The second segment 216 engages with the side wall 114. The third segment 222 engages with the inner wall 122. The third segment is provided in opening, such as a notch or a blind hole, in the inner wall 122. Hence, the connecting device 200 may become connected relative to the first board in the transverse direction. The second engagement portion 230 engages with the inner wall 142. The engagement may be pretensioned, e.g. in complete analogy with the discussion above in relation to FIGS. 5*a-d*.

The first board is connected to the support element 300 by means of an attaching element 400, presently in the form of a screw, that is provided through the second lip 120 and through the hole 202 in the first engagement portion 210. Thereby, the connecting device 200 becomes horizontally connected relative to the first board.

Figure 6B:
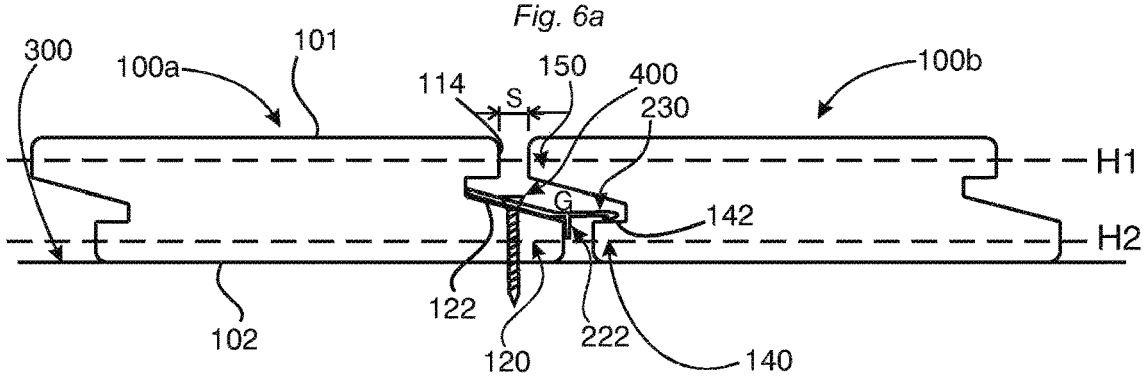

The second segment 216 and/or third segment 222 are optional and may be omitted in other embodiments, one of which is illustrated in FIG. 6*b* which utilizes the connecting device 200 in accordance with FIG. 4*d*. The downwardly extending third segment 222 engages with the side wall 124 and has a shape that is corresponding thereto. The downwardly curved end section 234 engages with the inner wall 142. The engagement may be pretensioned, e.g. in complete analogy with the discussion above in relation to FIGS. 5*a-d*.

Figure 6C:
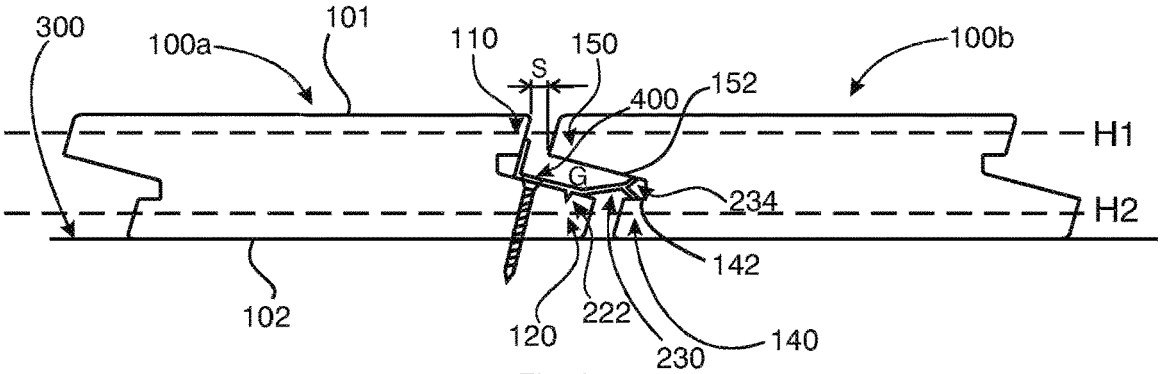

FIG. 6*c* illustrates the same embodiment as in FIG. 6*a*, except that the third segment 222 is pressed into the inner wall 122. The third segment 222 may be a protrusion 215. The third segment 222 may be sharp. Thus, the connecting device 200 may become connected relative to the first board in the transverse direction. The second engagement portion 230 comprises an end section 234 comprising an upper and a lower portion in complete analogy with the embodiment in FIG. 5*d*. In one embodiment (not shown) there is only an upper portion and no lower portion.

Any of the embodiments of the first 210, the intermediate 220 and the second 230 engagement portions, and fixing portions 212 or third segments 222, described above in relation to FIGS. 5*a-d* or FIGS. 6*a-c*, respectively, may be combined and/or exchanged with each other.

Figure 6D:
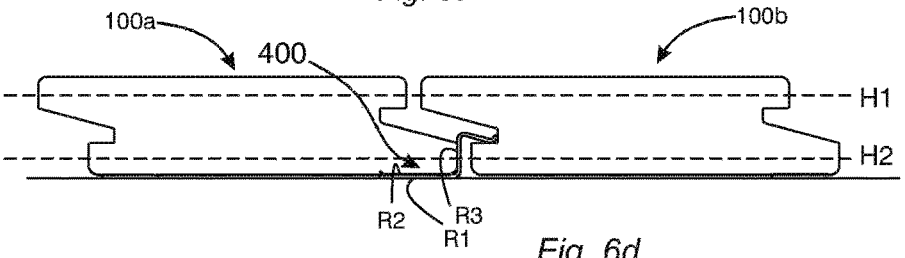
Figure 6E:
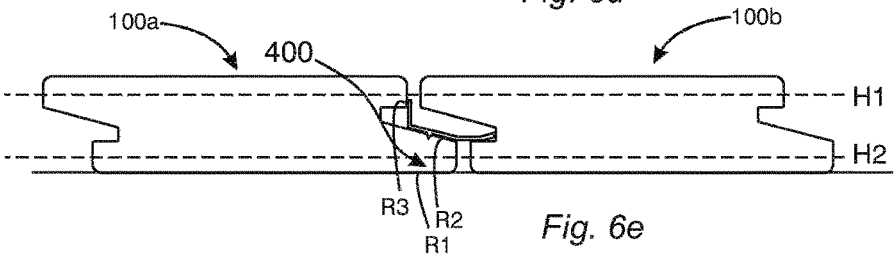

FIGS. 6*d* and 6*e* illustrate embodiments wherein the connecting device 200 engages with the second lip 120 from below and above, respectively, in analogy with the above, but in where an adhesive 400, such as glue, is used for connecting the connecting device 200 to the support element 300 and/or to the first board. The adhesive may be applied in one or several of the regions R1, R2 and R3 in FIGS. 6*d* and 6*e*. Optionally, the embodiments in FIGS. 6*d-e* may be combined with any of the embodiments in FIGS. 5*a-d* and 6*a-c* so that a mechanical fastening device, such as a screw or a nail, is used in combination with the adhesive in accordance with the disclosure above.

Figure 7A:
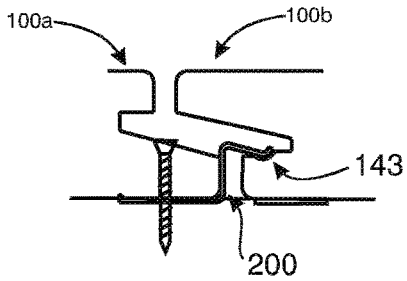
FIGS. 7*a-f* illustrate side views of embodiments of installed decking boards and embodiments of a rotatable connecting device.
Figure 7B:
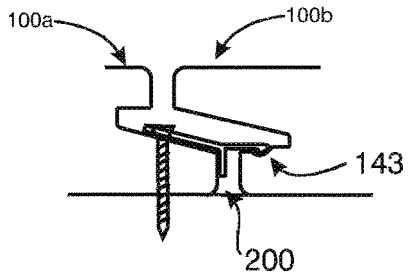

FIGS. 7*a-b* illustrate side views of embodiments of boards wherein an indentation 143 is provided in the inner wall 142. These embodiments may be particularly advantageous when the second engagement portion comprises a second section 234 that is curved, e.g. upwards or downwards. Once the first board 100*a* has been connected to the support element 300, the second board 100*b* may be angled or snapped into a vertically locked state with respect to the first board. Clearly, the indentation 143 and/or a curve second section 234 may be used in any of the embodiments of the present disclosure, in particular those in FIGS. 1, 2, 3*a-h*, 5*a-d*, 6*a-e* above and FIGS. 8*c*, 8*h*, 11*c-d* below.

Figure 7C:
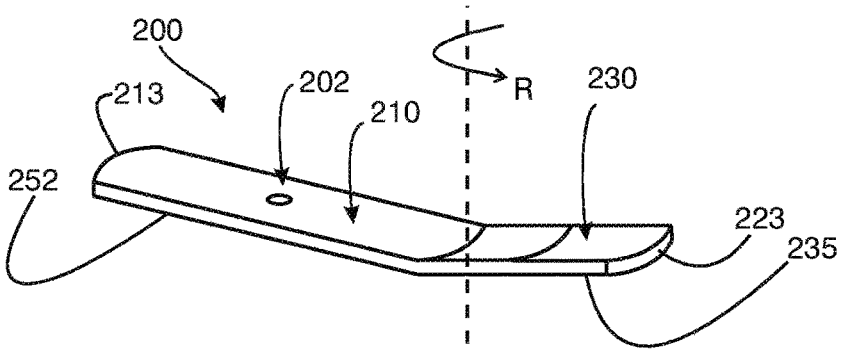
Figure 7D:
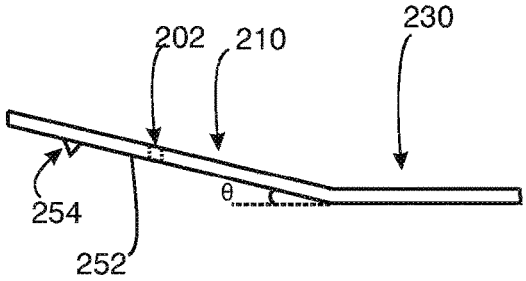

FIGS. 7*c-d* illustrates a perspective view and a side view of a rotatable connecting device 200 comprising a first 210 and a second 230 engagement portion that are arranged at an angle θ with respect to each other along their respective longitudinal extensions. In non-limiting examples, the angle θ may be between 0° and 45°, preferably between 10° and 20°.

An edge portion 213 of the first engagement portion is curved or bevelled. Thereby, the first engagement portion may be rotated more easily, especially when the edge portion engages with the third wall 132 in an installed state. A front portion 223 of the second engagement portion also is curved or bevelled. As seen in the front view in FIG. 7*e*, an underside 235 of the second engagement portion is rounded. This rounding may simplify installation and demounting of the boards and/or allows for an easier displacement of the second board 100*b*, especially along the longitudinal direction. The first engagement portion comprises a retaining element 254 on a lower side 252. The retaining element is configured to engage with or be pressed into the inner wall 122. Optionally, there may be no intermediate engagement portion.

Figure 7E:
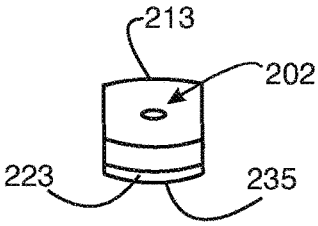
Figure 7F:
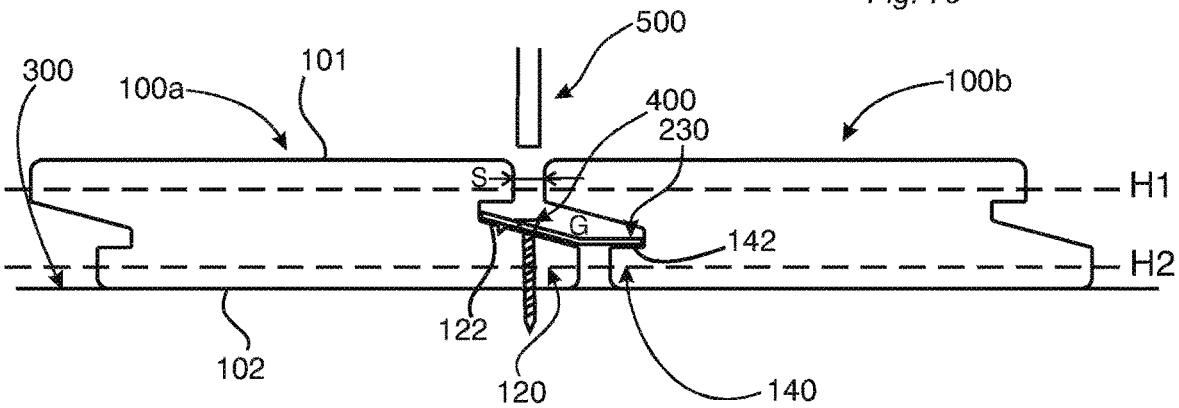

In FIG. 7*f* there is illustrated an embodiment of installed boards 100*a*, 100*b* wherein the connecting device 200 in FIGS. 7*c-e* is used. This embodiment is largely analogous to the embodiment in FIG. 6*a* wherein reference is made to the above discussion. More details are provided below in relation to FIGS. 11*c-d*. It is noted that a tool 500 may operate the connecting device through the space S, by operating and/or accessing the attaching element.

In any of the embodiments in FIGS. 5*a-d*, 6*a-e*, 7*a-b*, 7*f*, the second side portion of a board may be displaceable in the horizontal longitudinal and/or transverse direction in its vertically locked state.

Figure 8A:
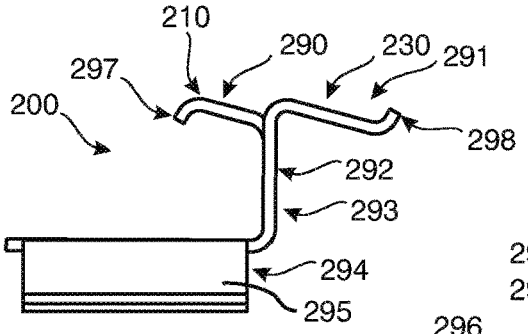
FIGS. 8*a-h* illustrate embodiments of connecting devices configured to be connected to joists as well as embodiments of their installation and their connections to decking boards.
Figure 8B:
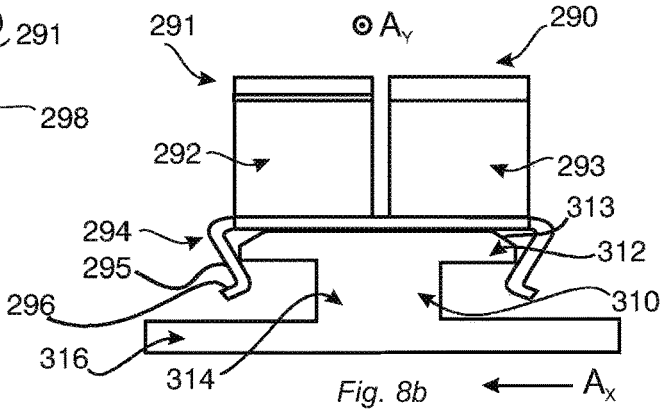

FIGS. 8*a* and 8*b* is a side view and front view, respectively, of an embodiment of the connecting device 200 which is configured to be releasably connected to a support element 300 in the form of a set of joists 310. The joists may be arranged parallel to each other, preferably fixed at a constant distance in between. In one example, the connecting device is displaceable with respect to a joist. In another example, the connecting device is fixed with respect to a joist. This connecting device is particularly suitable for WPC decking boards since it allows for a displacement of the boards, preferably both side edges 103, 104, along the longitudinal axis $A_X$. The connecting device is configured to be releasably connected to a board, preferably to a second hp. In this embodiment, the connecting device comprises a first engagement portion 210 comprising a first flange 290 and a second engagement portion 230 comprising a second flange 291. The first flange 290 forms an angle, preferably, an obtuse angle with respect to a vertical portion 293, e.g. between 90° and 120°, and the second flange 291 forms an angle, preferably, an acute angle with respect to a vertical portion 292, e.g. between 60° and 90°. In the present embodiment, the vertical portions 292, 293 are separated from each other along the axis $A_X$. The first 290 and second 291 flanges are separated from each other along the axis $A_X$. It is clear that in one embodiment (not shown), at least portions of, or even the entire, first 290 and second 291 flanges may be provided side by side along the axis $A_X$. The first engagement portion 210 further comprises a tooth 297 at an outer portion of the first flange 290 that is curved downwards towards a base portion 294. Moreover, the second engagement portion 230 further comprises an outer portion 298 that is curved upwards away from the base portion 294. The flanges 290, 291 are connected to the base portion 294 via the vertical portions 292, 293. The flanges 290, 291 and the base portion 294 have longitudinal extensions along the axis $A_X$ when the connecting device is connected to the joist 310. The base portion 294 is configured to be connected to a joist 310, preferably by snapping and preferably by a vertical displacement. The snapping function is provided by means of a pair of resilient retaining elements 295 that are tapering in a direction along $A_Z$ away from the flanges 290, 291. The retaining elements 295 comprise guiding portions 296 at their end parts. The joist 310 extends along the $A_Y$ axis and has a top portion 312, an intermediate portion 314 and a bottom portion 316. A width along the $A_X$ axis of the intermediate portion 314 is smaller than a width of the top portion 312. The top portion 312 comprises slanted portions 313 that are configured to cooperate with the guiding portions 296 during snapping of the connecting device 200 onto the joist 310.

Figure 8C:
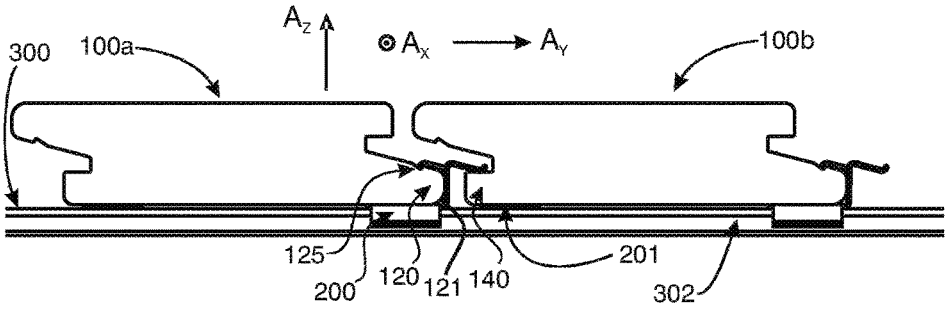

FIG. 8*c* is a side view of an embodiment in which a connecting device 200 as shown in FIGS. 8*a-b* is connected to a joist 310. In an installed state of the first 100*a* and second 100*b* boards the first flange 290 engages with the second lip 120 and connects the first board to the joist 310 and hence to the support element 300. The second lip 120 is further locked to the connecting device in a horizontal transverse direction along $A_Y$, since the tooth 297 is arranged in a notch 125 provided in the second lip 210. Moreover, the second flange 291 engages with the first lip 140 and locks the second board vertically with respect to the first board. The second flange 291 may engage with the first lip 140 with pretension, e.g. in complete analogy with the discussion above in relation to FIGS. 5*a-d*. Elevation elements 201 are provided under the first lips 140.

Figure 8D:
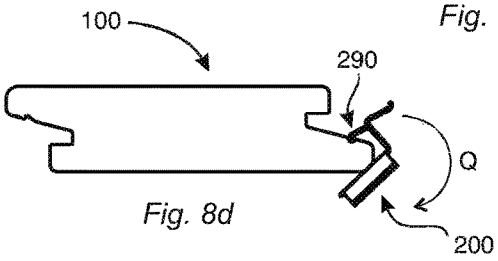

The connecting device 200 may be horizontally and/or vertically connected to a board 100 by a rotational movement. According to the embodiment in FIG. 8*d*, during installation of the connecting device, the first flange 290 is provided in the notch 125 and then rotated around the second Hp 120 while the first flange 290 is provided in the notch 125 (arrow Q). Hence, a rotational axis may be provided in the notch. The second lip 120 may be chamfered between the side wall 124 and the second surface member 102. Thereby, the connecting device may be rotated more easily. In one embodiment, the base portion 294 abuts or is separated from the second lip 120 during rotation, e.g. due to chamfering. In one embodiment, the base portion 294 is compressed, or is pressed into, the material of the second lip 120 during rotation. The connecting device may be snapped onto the board.

Figure 8E:
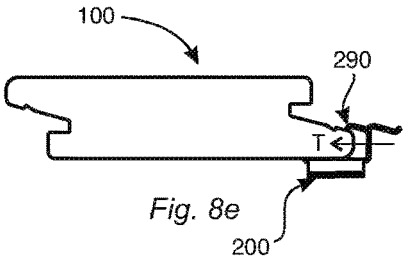

As shown in FIG. 8*e*, the connecting device 200 may be horizontally and/or vertically connected to a board 100 by a horizontal relative displacement between the connecting device and the second lip 120, preferably by a snapping action (arrow T). In one embodiment, the first flange 290 is resilient and during installation it bends upwards away from the second lip in an initial stage and bends downwards towards the second lip in a final stage, preferably by snapping. In one embodiment, the first flange 290 is pressed into the material of the second hp 120 during the horizontal displacement until the connecting device 200 reaches its installed position. The material of the second hp may be compressible and/or flexible. Both of the embodiments in FIGS. 8*d-e* may be combined.

Figure 8F:
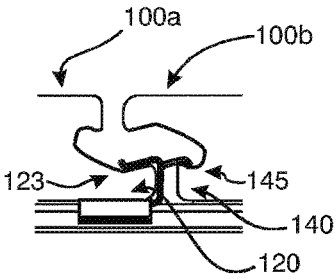

FIG. 8*f* shows a similar embodiment as in FIG. 8*c*, but wherein the first flange 290 forms an acute angle with respect to the vertical portion 293, e.g. between 60° and 90°, and preferably comprises an outer portion 297 that is curved upwards away from the base portion 294. The outer portion 297 is provided in an indentation 123 in the second lip 120. The second lip increases in thickness outwardly. Moreover, the second flange 291 forms an obtuse angle with respect to the vertical portion 292, e.g. between 90° and 120°, and preferably comprises an outer portion 298 that is curved downwards towards the base portion 294. The outer portion 298 is provided in a notch 145 in the first lip 140. In one example, the board 100*b* is transversely connected to the connecting device, preferably in two opposite directions, and the board 100*a* is transversely displaceable relative to the connecting device.

Figure 8G:
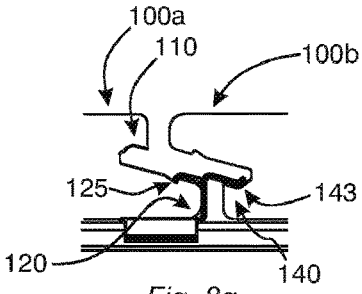
Figure 8H:
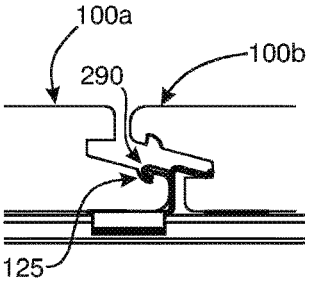

The embodiment in FIG. 8*g* is the same as the one in FIG. 8*c*, except that the inner wall 142 comprises an indentation 143. In FIG. 8*c* the inner wall 142 is planar. The embodiment in FIG. 8*h* is the same as the one in FIG. 8*c*, except that the first flange 290 comprises a tooth 297 that is configured to engage with, preferably an outer portion of, a notch 125 provided in the inner wall 122. The tooth 297 is curved downwards and extends at least partly towards the vertical portion 293. The tooth 297 may be resilient. In one example, the engagement between the tooth 297 and the notch 125 is pretensioned. In one example, the tooth abuts the outer portion of the notch. In one example, the tooth is pressed into the material of the outer portion of the notch.

In any of the embodiments in FIGS. 8*c*, 8*f-h*, a shape of a portion of the indentation 123, 143 and/or the notch 125, 145 may correspond to a shape of a portion of the first 290 and/or second 291 flange. Clearly, any of the embodiments of the first and second flanges, the first and second engagement portions, and any of the embodiments of the first and second lips described above may be combined.

In FIGS. 8*c*, 8*f-h* the connecting device is vertically and horizontally connected relative to the first board in both opposite directions being parallel with $A_Z$ and $A_Y$, respectively. It is conceivable that there is a horizontally connection only in one direction being parallel with the $A_Y$ axis, preferably directed outwards.

Figure 9A:
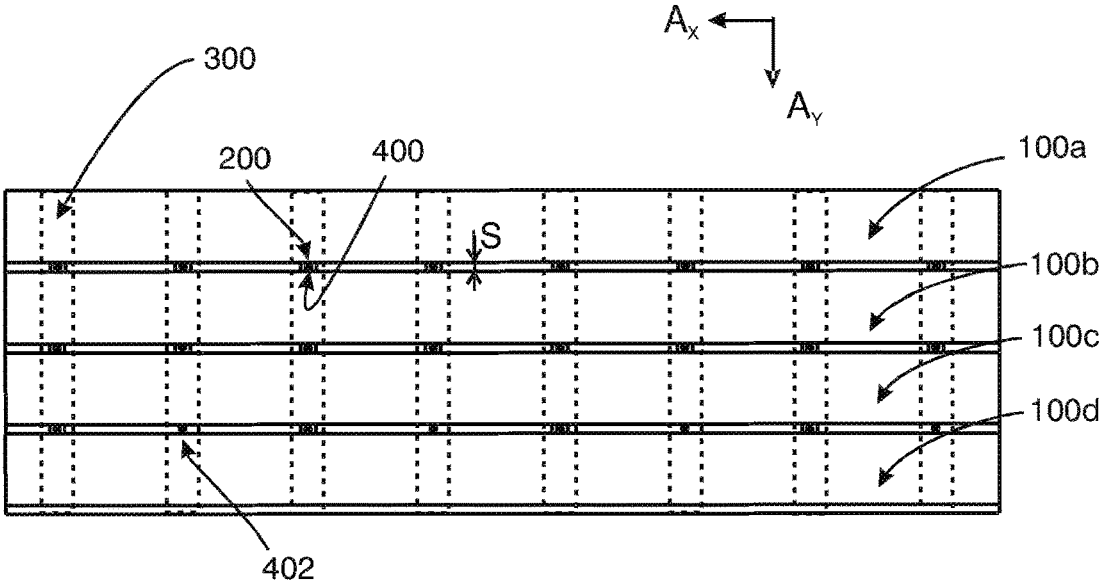
FIG. 9*a-d* illustrates an embodiment of an installed set of decking boards as seen in a top view and an embodiment of a connecting device in perspective views and a side view.

According to the embodiment in FIG. 9*a*, there is illustrated in a top view a set of boards comprising a plurality of essentially identical boards 100*a*, 100*b*, 100*c*, 100*d*, By essentially identical is here meant that the dimensions of the boards differ from each other under the same environmental conditions by less than 1-10%. It is clear, however, that in other embodiments, the dimensions of some or even all of the boards may vary. The boards 100*a-d* may be locked to each other in complete analogy with the locking of the boards 100*a-b* described above, e.g. in relation to FIGS. 5*a-d*, 6*a-e*, 7*a-b*, 7*f*, 8*c*, or 8*f-h*, whereby reference is made to the above. For example, a third board 100*c* may be locked to the second board 100*b* by a second connecting device 200 and a second attaching element 400, etc.

In FIG. 9*a* the attaching element 400 is accessible and at least partly visible from above as in FIGS. 6*a-c*, 6*e*, 7*b* and 7*f*. In one embodiment (not shown), however, the attaching element may be concealed from above as previously described. Concealment is possible since the boards may be installed in sequence, one after another: first the board 100*a* is connected to the support element 300, then the board 100*b* is provided next to the board 100*a*, optionally forming a horizontal overlap along the $A_Y$-axis as described above, and connected to the support element, and so on for subsequent boards. Preferably, the space S between the boards 100*a-d* is the same. The support element 300 comprises a plurality of joists 310, such as wood joists.

In one embodiment, illustrated in the lowermost row in FIG. 9*a*, the side edges may be connected by arranging fastening elements 402 and connecting devices 200 alternately along the side edges 103, 104, wherein the connecting devices are arranged in accordance with any of the embodiments of the present disclosure and wherein the fastening elements 402 are provided through the second lip 120 and are connected to the support element 300 without any connecting device—see FIG. 6*a* for an example of such a fastening element 402 as seen in a side view. The fastening element 402 may a screw, a nail, etc. as described above.

Figure 9B:
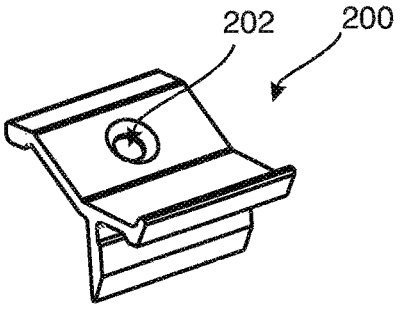
Figure 9C:
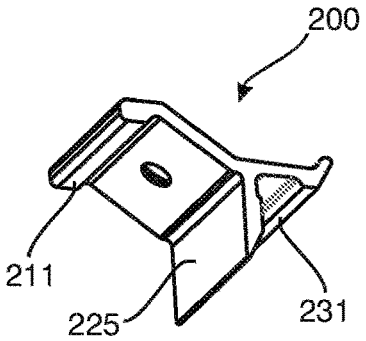
Figure 9D:
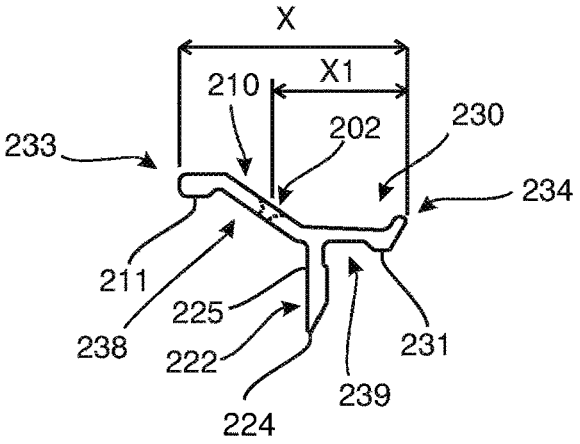

FIGS. 9*b-d* show an embodiment of a connecting device 200 in perspective views and in a side view, drawn to scale. A third segment 222 is formed at an angle with respect to the second engagement portion 230, generally by an angle 45°-135°, preferably 90°. The third segment, preferably an inner surface 225 thereof, is configured to engage with the side wall 124. The third segment 222 may counteract twisting of the connecting device during its installation. Inner sections 238 and 239 of the first and second engagement portions are inclined with respect to each other, by an angle 10°-50°, preferably 20°-45°. An end section 224 of the third segment is tapering. Thereby, the third segment may engage with or be pressed into the support element more easily. Support surfaces 211 and 231 of end sections 233 and 234 of the first 210 and second 230 engagement portions are configured to engage with the grooves 130 and 160, respectively. The support surfaces are essentially parallel with each other and are provided at different vertical heights, the support surface 211 preferably being provided vertically above the support surface 231 in the installed state. The second engagement portion comprises an end section 234 that is curved or forming an angle with respect to an overall lengthwise extension of the second engagement portion and at least partially extends in a direction away from the third segment. Thereby, the board may be angled into position during installation. A thickness, preferably a maximal thickness, of the inner section 239 of the second engagement portion preferably is smaller than a thickness, preferably a maximal thickness, of its end section 234. There is provided a hole 202 in the first engagement portion 210. The hole 202 is countersunk and comprises a frustroconical portion and a cylindrical portion. A cross-section of the hole is circular, but it may assume other shapes, such as squares or rectangles. The hole may be oblong, e.g. with rounded short edges. The connecting device comprises a covering layer in the form of an anodic layer. Optionally, the cylindrical portion does not have any covering layer. Preferably, the connecting device in FIGS. 9*b-d* has balanced torsional moment as explained above.

Preferably, a ratio X1/X, measured in percentage, between a horizontal extension X1 from a centre of the hole 202 to an end part of the second engagement portion 230 and a total horizontal extension X of the connecting device is 50%-80%, such as around 60% as in FIGS. 9*b-d*. By having a large extension, a flexibility of the second engagement portion may be increased which may simplify its installation. By the support surface 211, the inclined first engagement portion 210, and the third segment 222, a tilting of the connecting device during installation thereof may be counteracted.

Preferably, any of the connecting devices of the present disclosure, especially that in FIGS. 9*b-d*, has a constant cross-section along a width direction of the connecting device. Thereby, it may be produced by extrusion or by bending and processing a metal sheet of constant width, etc.

In an alternative embodiment (not shown), the end section 233 of the first engagement portion 210 is missing and the first engagement portion only comprises the inner section 238 of the first engagement portion that is inclined with respect to the second engagement portion. Other features of the connecting device may be identical to those described above in relation to FIGS. 9*b-d*.

Figure 10A:
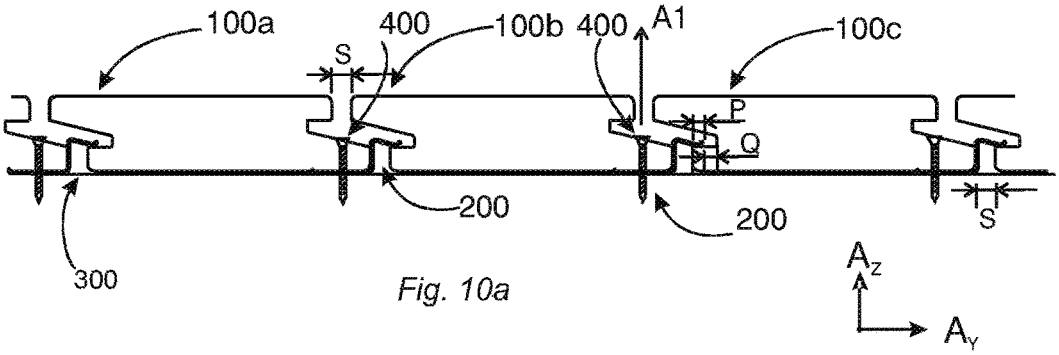
FIGS. 10*a-e* illustrate embodiments of a method of demounting a decking board and replacing it with a new decking board using the connecting devices of the type in FIGS. 4*a-b*.
Figure 10B:
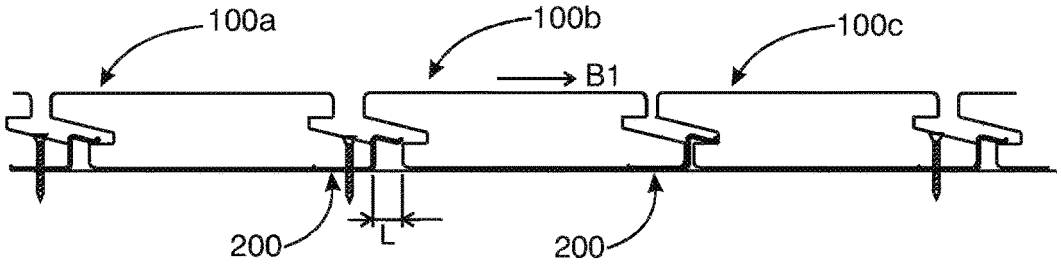
Figure 10C:
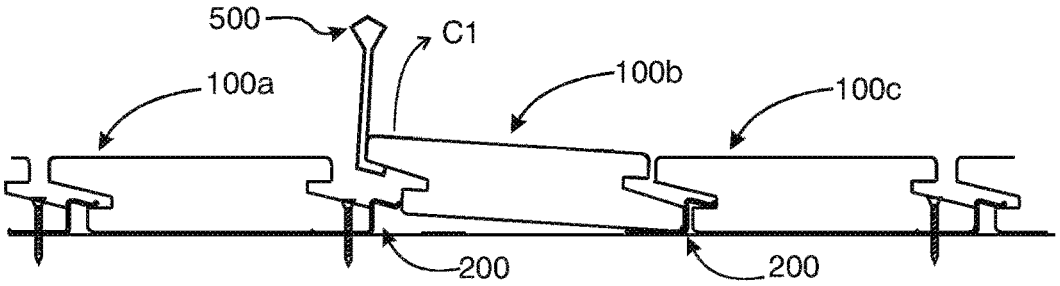

FIGS. 10*a-c* illustrate an embodiment of a method of demounting a second board 100*b* from a set of installed boards as seen in side views. The second attaching element 400 between the second 100*b* and third 100*c* boards is removed (arrow A1). Thereby, the horizontal relative connection between the second connecting device 200 and the second board 100*b* is released. Since the second attaching element has been removed, the board 100*b* may be displaced relative to the first connecting device 200. Then, as shown in FIG. 10*b*, the second board 100*b* is horizontally translated towards the third board 100*c*, so that its first lip 140 becomes free from the first connecting device 200 (arrow B1) and hence vertically unlocked with respect to the first board 100*a*. The translation is possible since the second connecting device 200 is separated from the third wall 162 of the board 100*c* by an inner horizontal separation Q in the installed state. Then, as shown in FIG. 10*c*, the second side edge 104 is angled upwards (arrow C1) and removed, manually or by a tool 500.

Figure 10D:
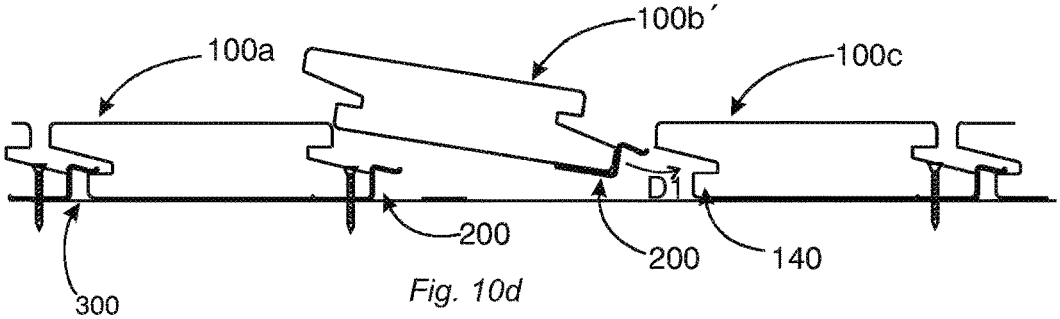
Figure 10E:
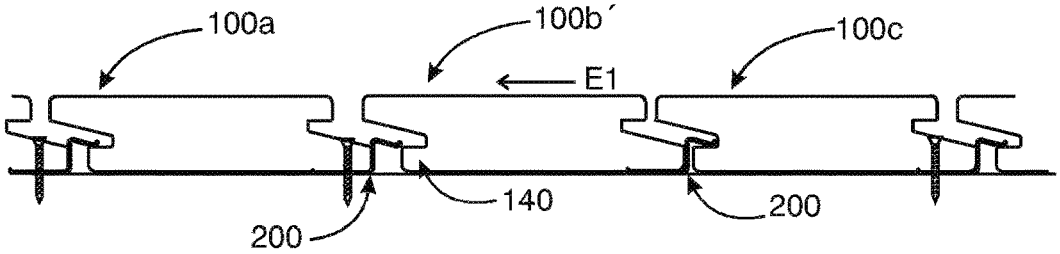

The second board 100*b* may be replaced by a new second board 100*b*' as shown in the embodiment in FIGS. 10*d-e*. Here, it is installed by first adhering a second connecting device 200 to the second lip 120 by means of a tape, an adhesive, such as glue, or a nail or the like, in this embodiment from below. Clearly, other methods are conceivable, e.g. holding the second connecting device in place by hand. Thereafter, the demounting steps described above may be followed in reverse order. As shown in FIG. 10*d*, the second board 100*b*' is angled and displaced into a position in which the second engagement portion 230 of the second connecting device 200 engages with the first lip 140 of the third board 100*c* (arrow D1) and a surface member 101, 102 of the second board becomes parallel with the support element. As shown in FIG. 10*e*, the second board 100*b*' is then displaced towards the first board 100*a* (arrow E1) so that the second engagement portion 230 of the first connecting device 200 engages with the first lip 140 of the second board 100*b*' and a predetermined space S is obtained (cf. FIG. 10*a*). Finally, the second attaching element 400 is connected to the support element 300 by providing it through the second connecting device 200.

In the embodiment in FIGS. 10*a-e*, the space S is substantially equal or larger than a horizontal overlap P along the axis $A_Y$ of the second engagement portion 230 and the inner wall 142 in the installed state. Moreover, the inner horizontal separation Q of the second groove 160 of the third board 100*c*, wherein there is no horizontal overlap P, is substantially equal or larger than the horizontal overlap P. Thereby, an arrangement of the second board 100*b*, 100*b*' next to the third board 100*c*, such that the first lip 140 of the second board 100*b*, 100*b*' is free or horizontally separated from the first connecting device is possible. It is noted that the sum of P and Q may be a depth along the axis $A_Y$ of the second groove 160.

In the embodiments illustrated in FIGS. 11*a-d*, the type of connecting devices 200 illustrated in FIGS. 4*c-d*, 6*a-c* and 9*b-d* described above are utilized. When demounting a second board 100*b*, the first and second attaching elements 400 are first removed from the support element 300 (arrow A2). Thereby, the second board becomes vertically unlocked with respect to the first board 100*a* and the horizontal relative connection between the second connecting device 200 and the second board is released. The second board may then be removed (arrow B2), e.g. by angling. Optionally, the first and/or second connecting devices 200 may be removed through the space S before removing the second board (arrow C2).

A new second board 100*b*' may be placed between the first 100*a* and third 100*c* boards. Then the steps above may be reversed: a first and a second connecting device 200 is provided in engagement with the side walls 114 of the first and second boards, respectively, and with the lips 120, 140 of a respective pair of boards from above; then a first and a second attaching element 400 is provided through the second lips 120 of the first and second board, respectively, and are connected to the support element 300.

Figure 11A:
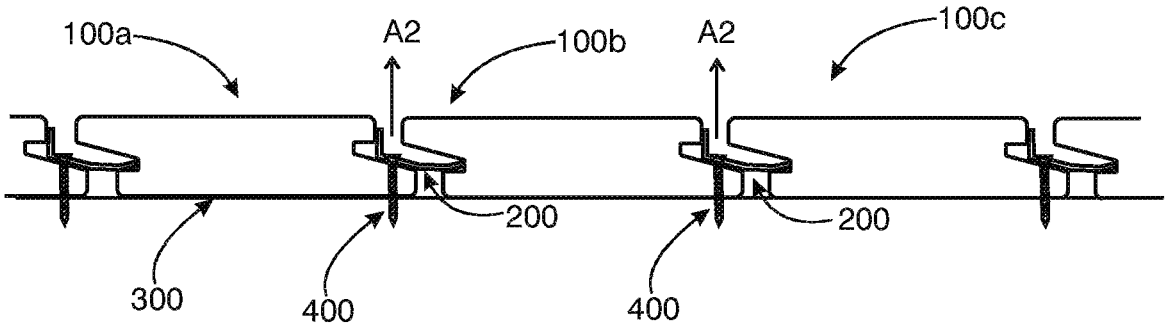
FIGS. 11*a-d* illustrate embodiments of a method of demounting a decking board and replacing it with a new decking board using the connecting devices of the type in FIGS. 4*c-d* and FIGS. 9*b-d*.
Figure 11B:
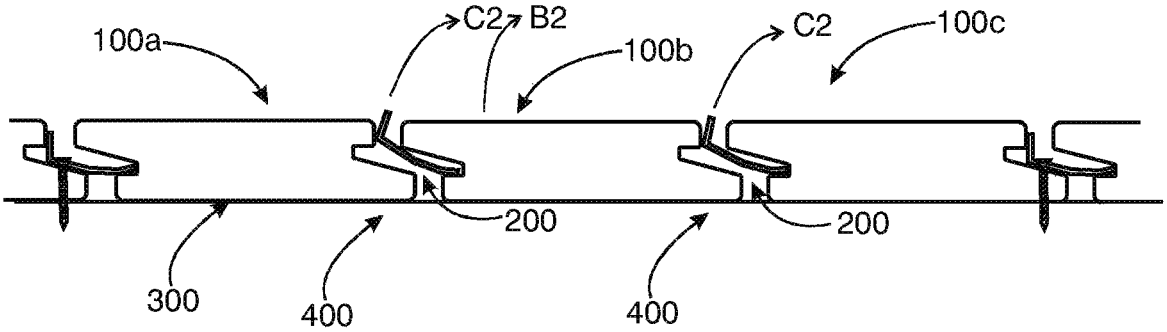
Figure 11C:
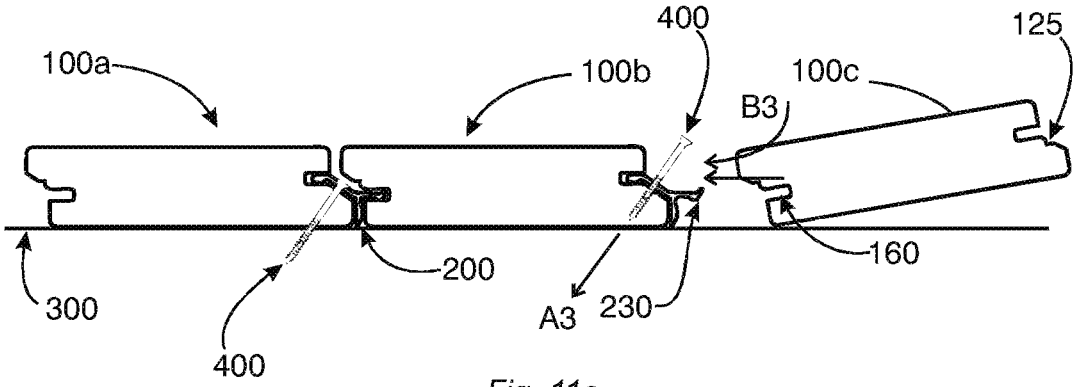
Figure 11D:
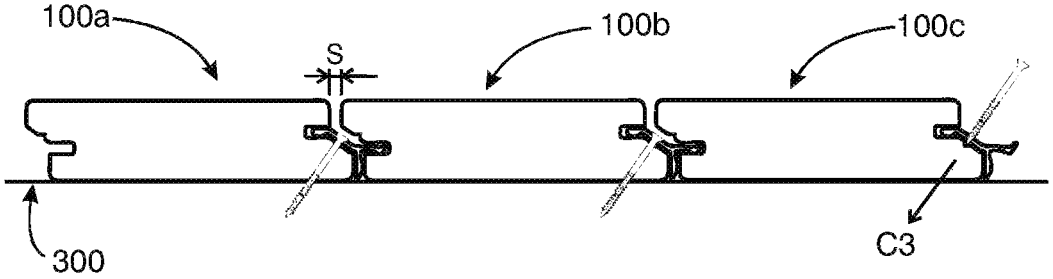

FIGS. 11*c-d* illustrate embodiments of boards 100*a-c* interconnected by the connecting device 200 in FIGS. 9*b-d* and their installation. Here, the boards are configured to be installed and/or demounted sequentially. The connecting device is not operable or accessible through the space S since the attaching element cannot be accessed. FIG. 11*c* shows an installed first board 100*a* using a first attaching element 400 and a first connecting device 200 and the insertion of a second attaching element 400 through a second connecting device 200 and through the second lip 120 of a second board 100*b*, thereby connecting it to the support element 300 (arrow A3). A notch 125 in the lips 120 guides the attaching elements and/or the connecting devices into position. In particular, the notch together with one or several of the support surfaces 211, 231 and the inner surface 225 may guide the connecting device into position. The attaching elements are here provided as screws having countersunk heads configured to cooperate with the countersunk hole 202. Thereafter, a third board 100*c* is displaced and/or angled towards the second board and the second engagement portion 230 of the second connecting device is inserted into the groove 160 (arrow B3) for obtaining vertical locking of the board 100*c* to the board 100*b*, preferably with pretension. The installed boards are shown in FIG. 11*d*. Demounting of the boards may be done sequentially in the reverse order. In FIGS. 11*c-d* the attaching elements, preferably in the form of screws, are provided at an angle with respect to the support element. Preferably, the attaching elements are provided perpendicularly to the inner wall 122. Additional connecting devices and boards may be connected in a similar manner (arrow C3).

In some embodiments, it is preferred—especially in the case when the boards are made of softwood which may shrink over time—that there is a vertical space, such as 0.3-15 mm or more preferably 0.5-1.5 mm, between the support member 300 and the end section 224 of the third segment 222 in the installed state. Here, there is no direct engagement between the connecting device and the support member.

Alternatively, the second board 100*b* in FIG. 11*a-b* or 11*c-d* may be demounted as in FIG. 10*b* by horizontally translating the second board 100*b* towards the third board 100*c*, so that its first lip 140 becomes free from the first connecting device 200 and hence vertically unlocked with respect to the first board 100*a*. In this case, there has to be an inner horizontal separation Q in the installed state in complete analogy with the discussion above in relation to FIGS. 10*a-b*. Optionally, the attaching elements 400 may be partly or completely accessible from above when there is an inner horizontal separation Q.

In some embodiments, a vertical extension, preferably a maximal vertical extension, of the groove 160 is smaller than a thickness, preferably a maximal thickness, of the end section of the second engagement portion of the connecting device. This is particularly advantageous for boards comprising a material whose volume changes, e.g. decreases, over time, for example a hygroscopic material or a material being susceptible to thermal expansion/contraction. The material may be an impregnated and/or pressure-treated material. Hence, by having a smaller vertical extension of the groove 160, a locking capability of the locking system may be substantially maintained over time.

In one embodiment, there is a minimal space S between the boards, given by a thickness of the third segment 222.

Figure 12A:
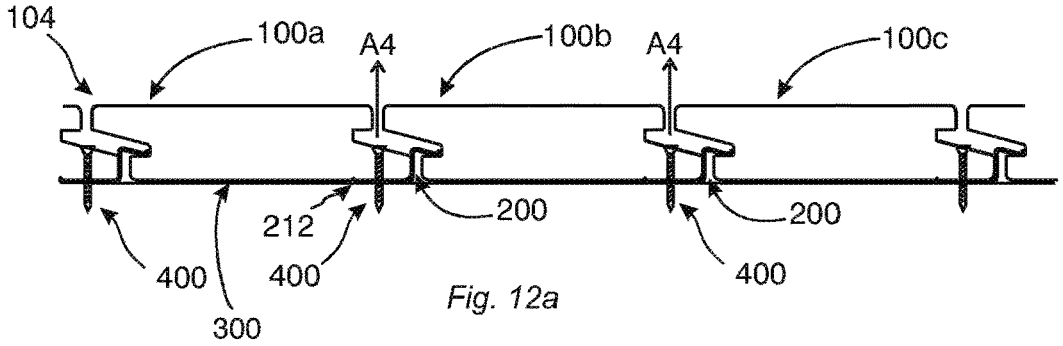
FIGS. 12*a-e* illustrate embodiments of a method of demounting and replacing a decking board using the connecting devices of the type in FIGS. 4*a-b*.
Figure 12B:
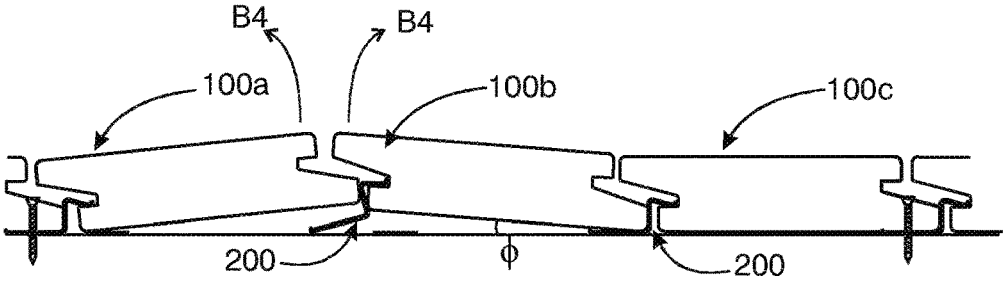

FIGS. 12*a-b* and 12*c-d* are side view illustrations of embodiments of methods of demounting and replacing a second board 100*b* by a new second board 100*b*' having connecting devices 200 as in FIGS. 4*a-b*. During demounting, at least the first and second attaching elements 400 are removed in a demounting operation of the second board 100*b* (arrows A4). Optionally, also the attaching element 400 providing vertical locking of the first board 100*a* at its second longitudinal side edge 104 is removed. Then, as shown in FIG. 12*b*, the first 100*a* and second 100*b* boards are angled and/or translated and removed (arrows B4). More specifically, the first 103 and second 104 side edges of the first and second board, respectively, may be angled upwardly away from the support element 300.

Figure 12C:
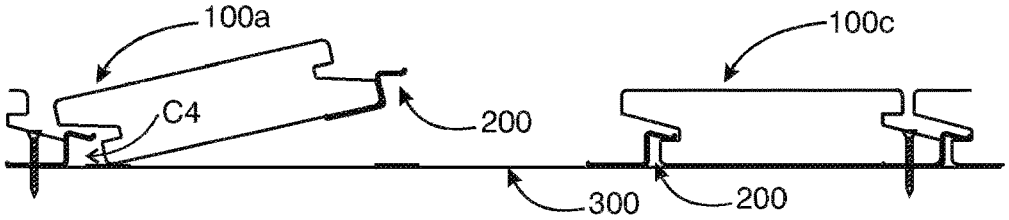
Figure 12D:
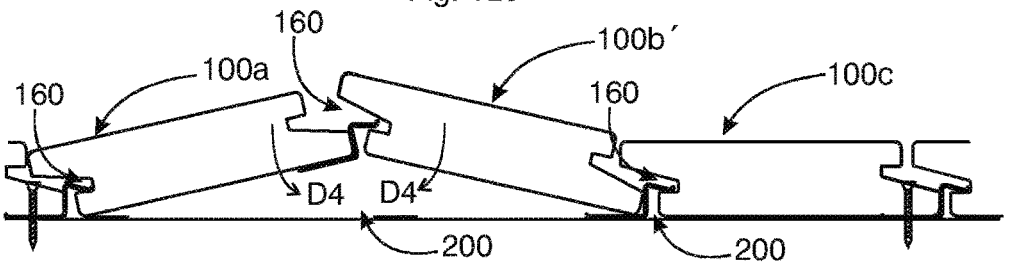

When installing the new second board 100*b*' the first connecting device 200 may be temporarily or permanently adhered to an underside of the second lip 120 of the first board 100*a*, e.g. by means of a tape, an adhesive, such as glue, or a nail or the like, see FIG. 12*c*. Thereby, it will not fall off during installation. The second connecting device 200 is inserted into the second groove 160 of the third board 100*c* and rests on the support element 300. It may be adhered to the support element, e.g. by means of tape. Optionally, however, also the second connecting device 200 may adhere to the second board 100*b*' in a similar manner to the first. Then, the demounting steps above are reversed. As shown in FIG. 12*c*, a connecting device is inserted into the second groove 160 of the first board 100*a* (arrow C4). The boards 100*a*, 100*b*' are provided in an angled position as shown in FIGS. 12*c-d* and, before or after this action, the first connecting device is inserted into the second groove 160 of the board 100*b*'. Then the boards 100*a*, 100*b*' are angled downwards toward the support element (arrows D4) until the second surface members 102 of the boards 100*a*, 100*b*' are provided in contact with the support element, see FIG. 12*d*. At this point, the boards 100*a*, 100*b*', 100*c* are aligned in a horizontal and transverse direction. The intermediate portion 220 may abut the side walls 124 and the second engagement portion 230 may engage with the inner wall 142 and/or third wall 162.

Figure 12E:
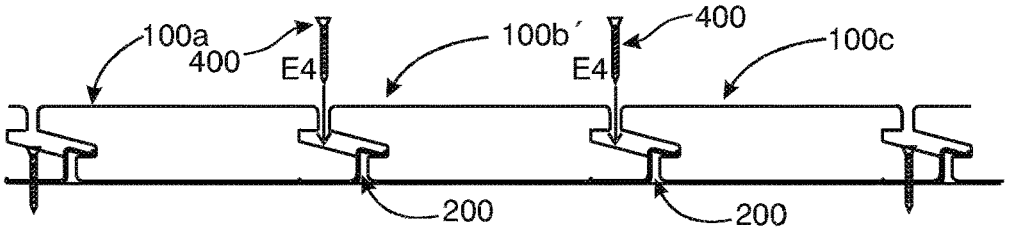

Thereby, the horizontal spaces S between the boards may become fixed. Finally, as shown in FIG. 12*e*, the first and second attaching elements 400 are provided through the second lips 120 for connecting them to the support element (arrows E4).

Figure 13A:
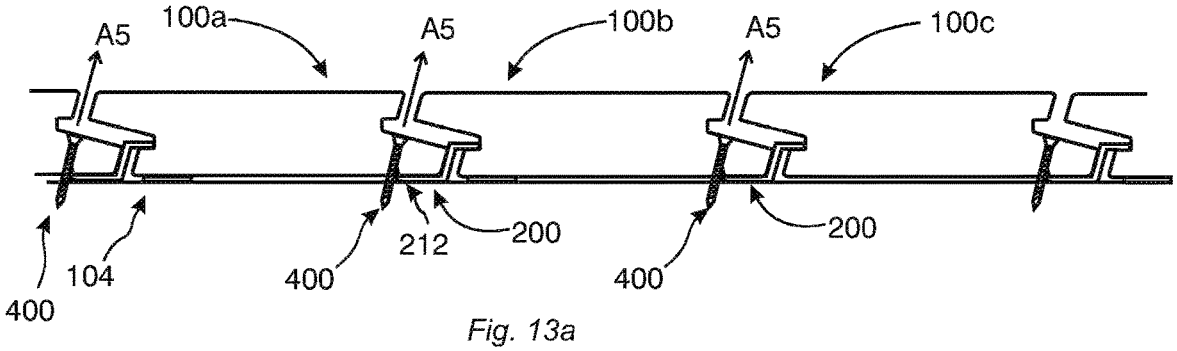
FIGS. 13*a-d* illustrate embodiments of method of demounting and replacing a decking board using the connecting devices of the type in FIGS. 4*a-b* and FIGS. 7*c-e*.
Figure 13B:
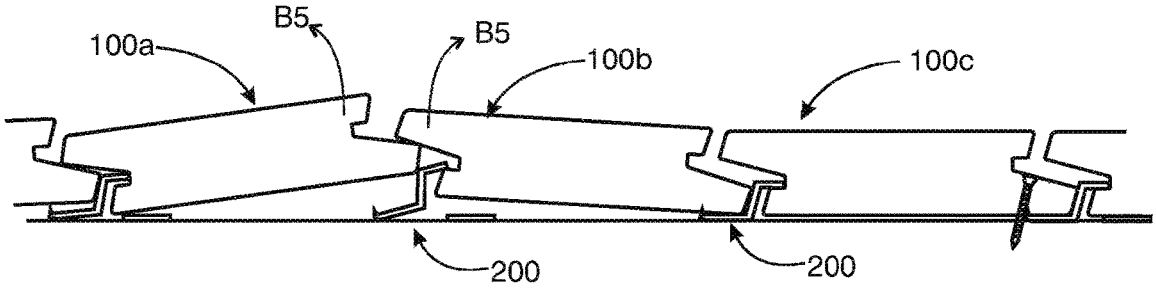

In the embodiment illustrated in FIG. 13*a* the first and second attaching elements 400 are provided outside of, in this case inwardly of, the first and second connecting devices, respectively, as described in the embodiment in FIG. 5*c*. The methods of demounting and installation are similar as described above in relation to FIG. 10*a-e* or 12*a-e*. Here, however, the first and second attaching elements 400, and preferably also the attaching element providing vertical locking of the first board 100*a* at its second side edge 104, are removed in a demounting operation of the second board 100*b* (arrows A5). However, in one example (not shown), only the second attaching element is removed. By means of the removal of the three attaching elements, a pressure on the fixing portions 212 from the boards is released and the connecting devices 200 may be removed. Then, as shown in FIG. 13*b*, the boards 100*a*, 100*b* are angled and/or translated (arrows B5) and removed.

In the embodiments of FIGS. 12*a-b* and 13*a-b*, the first connecting device 200 may disengage from the second board 100*b* when the second surface member 102 of the second board 100*b* has been angled above a critical angle $\phi_{crit}$ with respect to a horizontal extension of the support element 300, cf. the non-critical $\phi$ angle in FIG. 12*b*. Typically, it will fall off towards the support element by the force of gravity. By way of example, the critical angle $\phi_{crit}$ may be between 15° and 60°, preferably between 30° and 45°.

Figure 13C:
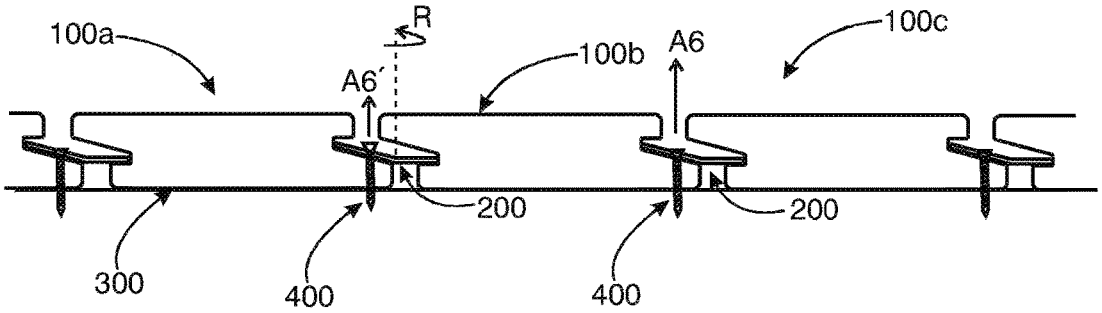
Figure 13D:
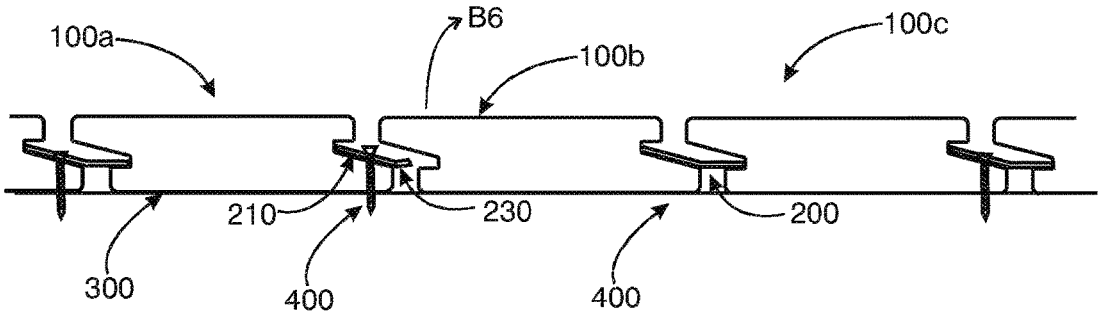

In the embodiment illustrated in FIGS. 13*c-d*, rotatable connecting devices 200 according to FIGS. 7*c-f* are utilized for connecting the boards. The demounting and installation methods are the same as described above in relation to FIGS. 11*a-b*, except that the second board 100*b* is vertically unlocked or locked with respect to the first board 100*a* by rotating the connecting device out of or into the groove 160 of the board 100*b*, preferably around an axis being substantially perpendicular to at least a portion of the inner wall 142, e.g. by a tool (arrow R; also, see FIG. 7*c*). Hence, while the second attaching element 400 has to be removed (arrow A6), the first attaching element 400 does not necessarily have to be removed when demounting the second board 100*b*; it suffices to loosen the first attaching element 400 (arrow A6') so that the second engagement portion 230 may be rotated out of the groove 160. In an example, the second engagement portion is rotated without loosening the first attaching element. Lastly, the second board may be removed (arrow B6).

In FIGS. 14*a-e* there are illustrated methods of installing and demounting a board where connecting devices 200 in accordance with any of the embodiments in FIGS. 8*a-h* are utilized. FIG. 14*a* illustrates an embodiment in which a connecting device is connected to the second lip 120 of a board 100*a* and to the support member in the form of joists 310. A second board 100*b* is then angled into position by engaging the first lip 140 with the second flange 291, and optionally with the support element, possibly via an elevation element 201, and angling the first side edge 103 downwards. In the embodiment in FIG. 14*b*, the second board 100*b* is instead placed in engagement with the support element, possibly via an elevation element 201, and is horizontally displaced towards the first board 100*a* into a position in which the second flange 291 engages with the first lip 140. In any of the embodiments, the second flange 291 may be resilient. During installation, it may bend upwards away from the first lip in an initial stage and bend downwards towards the first lip in a final stage, preferably by snapping.

The horizontal space S and/or the chamfers between the second surface members 102 and the side walls 114 and 154 are configured so that installation and demounting of the boards by means of angling is admitted. FIGS. 14*c-e* illustrate an embodiment for demounting a second board 100*b* by angling. For clarity, the support element 300 is suppressed. First, the second side edge 104 of the second board 100*b* is angled upwards, e.g. manually or by inserting a tool 500, preferably comprising a hook, through the space S, engaging it with the inner wall 152, for example with a notch 155 and pulling the second lip 150 upwards, see FIG. 14*c* (unbroken arrow). The angling action may be combined with a linear displacement of the second board, horizontally and/or vertically. During the angling action, the first board 100*a* will also be angled upwards (broken arrow) due to the interconnection between the first and second boards via the flanges of the connecting device 200, see FIG. 14*d*. Optionally, however, also the first side edge 103 of the first board 100*a* may be angled upwards in a similar manner, e.g. by a tool.

Eventually, when the first and second board have been angled more than a critical angle, e.g, 25°-50°, and optionally linearly displaced, the connecting devices will disengage from the support element, see FIG. 14*e*.

Figure 15A:
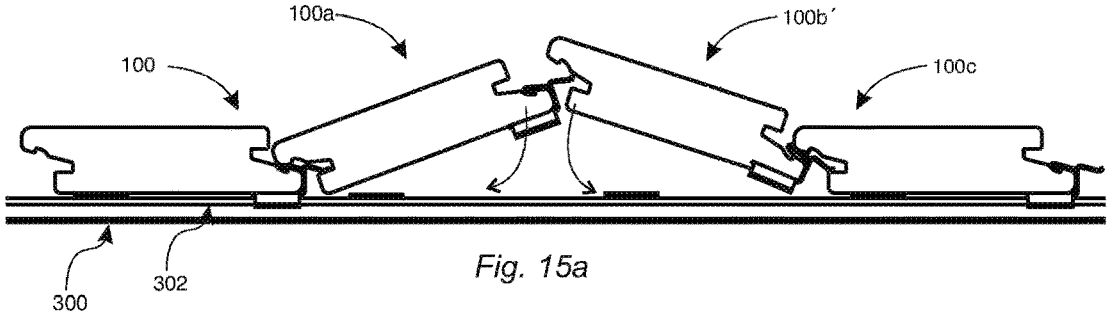
FIGS. 15*a-f* illustrate an embodiment of a method of installing a decking board using connecting devices in accordance with any of the embodiments in FIGS. 8*a-h* and embodiments of installed decking boards and connecting devices.
Figure 15B:
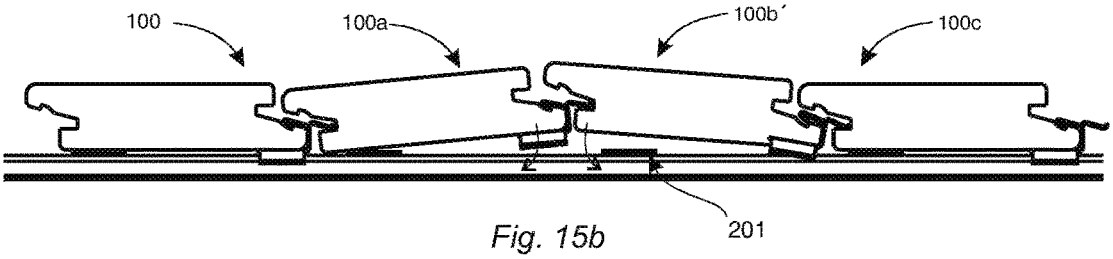
Figure 15C:
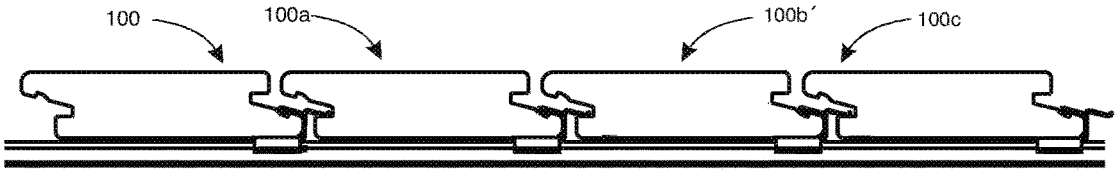

FIGS. 15*a-c* illustrate embodiments wherein a new second board 100*b*' is installed. First, the first and second connecting devices 200 are arranged on the second lips 120 of the first 100*a* and second 100*b*' boards, respectively. Then, the boards are arranged in an angled position while the second flanges 291 are arranged in the second groove 160 of the second 100*b*' and third 100*c* board. Optionally, elevation elements 201 are provided on the support element 300. Then the first 103 and second 104 side edges of the first 100*a* and second 100*b*' boards, respectively, are angled downwards (unbroken arrows), see FIG. 15*a*. As shown in FIG. 15*b*, the first and second connecting devices then contact the support element, optionally via elevation elements 201, and they may be snapped thereto for obtaining a final locked position of the boards, see FIG. 15*c*.

Figure 15D:
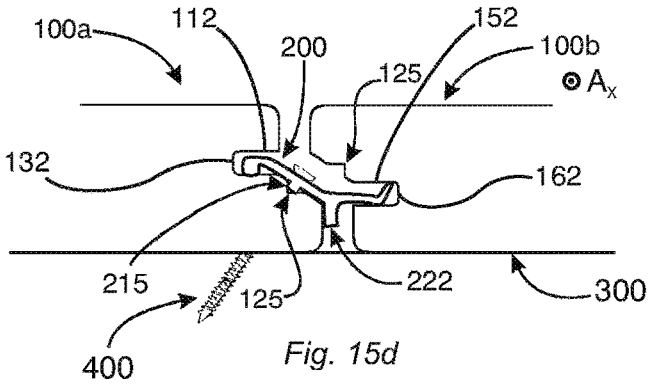
Figure 15E:
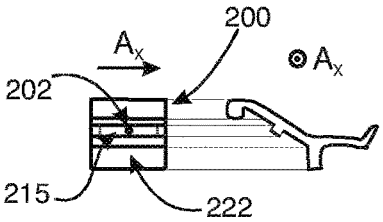
Figure 15F:
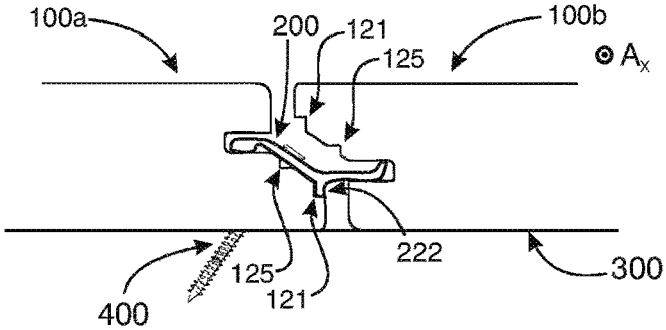

FIGS. 15*d-f* depict embodiments of connecting devices and installed boards similar to the embodiments described above, especially those in FIGS. 6*a-c*, 6*e*, 7*b*, 9*b-d* and 11*a-d*, wherein reference is made to the above.

However, in FIG. 15*d* the first engagement portion 210 of the connecting device 200 comprises another third segment in the form of a protrusion 215 which is disposed in a notch 125 of the first board. The protrusion is arranged on an underside of the first engagement portion 210. The protrusion has a rectangular cross-section but may have other cross-sections, such as triangular or semi-circular. Optionally, the protrusion may be sharp as in FIG. 6*c*. As shown in the backside view in FIG. 15*e*, the protrusion 215 extends along the entire connecting device (i.e. along $A_X$ in FIG. 15*d*)—this is preferred e.g. when the connecting device is extruded. The hole 202 is provided through the protrusion. Optionally, however, the protrusion may extend along a portion thereof, such as in end portions of the connecting device along $A_X$, and the hole may be provided next to the protrusion, see broken lines in FIG. 15*e*. There is a vertical space between the support member 300 and the third segment 222, cf. the discussion above.

Moreover, in FIG. 15*f* the second lip 120 of the board 100*a* comprises a recess 121. The recess is provided in an area joining the inner wall 122 and the side wall 124. The recess has a stepped profile. The third segment 222 is provided in the recess 121 in the installed state. Preferably, the recess 121 extends along the entire board (i.e. along $A_X$ in FIG. 15*f*). Optionally, however, the recess may extend only along a portion thereof, e.g. at locations along the side edge 103 where the connecting device is provided. Since the boards are rotationally symmetric in this embodiment, there is a notch 125 and a recess 121 also in the second side edge 104. Clearly, the embodiments in FIGS. 15*d-f* may be combined.

In FIGS. 15*d* and 15*f*, there is an inner vertical separation between the connecting device, in particular the first engagement portion 210, and the inner wall 112. Moreover, there is an inner horizontal separation between the connecting device, in particular the first engagement portion 210, and the third wall 132. In other embodiments, however, the inner vertical and/or horizontal separation may be zero, i.e. there may be contact. Furthermore, the connecting device, in particular the second engagement portion 210, engages with the inner wall 152. Also, there is an inner horizontal separation between the connecting device, in particular the second engagement portion 230, and the third wall 162. In other embodiments, however, there may be a non-zero vertical separation and/or the inner horizontal separation may be zero, i.e. there may be contact. By way of example, there may be contact between the connecting device and the wall 132 and/or 162 during installation of the boards; typically, the boards may shrink over time, e.g. when the boards comprise (impregnated) softwood, and then separation(s) may be created. Any of these examples of inner vertical and/or horizontal separation may be applied in any of the embodiments of the present disclosure, especially those in FIGS. 6*a-c*, 6*e*, 7*b*, 9*b-d* and 11*a-d*. Horizontal separation between the connecting device and the wall 132 and/or 162 is particularly advantageous when the boards are configured to be installed with the first lip of the first board and the second lip of the second board being in abutment with each other, whereby the horizontal space S between them is formed over time as the material of the boards decreases in volume, e.g. due to shrinkage.

The inventive concept has mainly been described above with reference to a few embodiments. However, as is readily appreciated by a person skilled in the art, other embodiments than the ones disclosed above are equally possible within the scope of the invention, as defined by the appended patent claims. A majority of the decking board embodiments in the present application have been presented to be rotationally symmetric around a longitudinal axis, and preferably are so, but it is understood that that rotationally asymmetric shapes are equally conceivable. For instance, the transverse extensions of the first lips 110, 140 may differ and/or the extensions of the second lips 120, 150 may differ. Any embodiment of the disclosure is valid for boards made of softwood and WPC boards, but also other materials. Moreover, the orders of the demounting and installation steps above are exemplifying and other orders are equally conceivable.

Embodiments

Further aspects of the inventive concept are provided below. Embodiments of these aspects are largely analogous to the embodiments for the first, second and third aspects, wherein reference is made to the above.

Item 1. A set of decking boards provided with a connecting system comprising a connecting device, the set of decking boards comprising:

a first decking board comprising a first side portion and a second decking board comprising a second side portion, each side portion extending along a longitudinal direction of the decking board, wherein each of said first and second side portions comprises:

a first lip and a second lip, wherein an extension of the second lip in a transverse direction of the decking board is larger than an extension of the first lip in said transverse direction of the decking board, wherein a first decking board is configured to be connected to a support element, wherein the second decking board is configured to assume a vertically locked state with respect to the first decking board, wherein in said vertically locked state:

said connecting device cooperates with the first decking board and with the second decking board;

there is a horizontal space between the first lip of the first decking board and the second lip of the second decking board; and there is a horizontal overlap between a portion of the second lip of the second decking board and a portion of the second lip of the first decking board, wherein the second decking board is configured to assume a vertically unlocked state with respect to the first decking board so that the second decking board becomes removable.

Item 2. A set of decking boards according to item 1, wherein the connecting device is operable and/or accessible through said horizontal space for assuming said vertically unlocked state, the horizontal space preferably being at least 1 mm, more preferably at least 5 mm, most preferably at least 10 mm.

Item 3. A set of decking boards according item 1 or 2, wherein the second decking board is configured to become removable when the second decking board is disconnected from the support element and/or when a third decking board assumes a vertically unlocked state with respect to the second decking board.

Item 4. A set of decking boards according to any of items 1 to 3, comprising the first and second decking board and/or the connecting device.

Item 5. A set of decking boards according to any of items 1 to 3, comprising a connecting device (200) for connecting decking boards comprising:

a first engagement portion (210) configured to engage with a second lip of a first decking board, optionally comprising a hole (202) for connecting the connecting device to a support element with an attaching element through the hole and the second lip, a second engagement portion (230) configured to engage with a first lip of a second decking board, optionally comprising an end section (234) being curved or forming an angle with respect to an overall lengthwise extension of the second engagement portion.

Item 6. A set of decking boards provided with a connecting system comprising a connecting device, the set of decking boards comprising:

a first decking board comprising a first side portion and a second decking board comprising a second side portion, each side portion extending along a longitudinal direction of the decking board, wherein each of said first and second side portions comprises:

a first lip and a second lip, wherein an extension of the second lip in a transverse direction of the decking board is larger than an extension of the first lip in said transverse direction of the decking board, wherein the first decking board is configured to be connected relative to the connecting device vertically and at least in a first horizontal direction, wherein the second decking board is configured to be vertically connected relative to the connecting device, and wherein the connecting device is configured to at least partially enclose the second lip of the first board while being connected to a support element, such as a joist.

Item 7. A set of decking boards according to item 6, wherein the first decking board is configured to be connected relative to the connecting device in a second horizontal direction being opposite to the first horizontal direction.

Item 8. A set of decking boards according to item 6 or 7, wherein the second decking board is configured to be connected relative to the connecting device at least in a first horizontal direction and, optionally, in a second horizontal direction being opposite to the first horizontal direction.

Item 9. A set of decking boards according to any of items 6 to 8, wherein the transverse direction is parallel with the first and/or second horizontal directions.

Item 10. A set of decking boards according to any of items 6 to 9, wherein the connecting device is configured to be displaceable with respect to the support element, preferably in a longitudinal horizontal direction of the support element.

Item 11. A set of decking boards according to any of items 6 to 9, wherein the connecting device is configured to be fixed with respect to the support element.

Item 12. A set of decking boards according to any of items 6 to 11, comprising the first and second decking board and/or the connecting device.

Item 13. A set of decking boards according to any of items 6 to 11, comprising a connecting device (200) for connecting decking boards comprising:

a first engagement portion (210) configured to engage with a second lip of a first decking board, optionally comprising a hole (202) for connecting the connecting device to a support element with an attaching element through the hole and the second lip, a second engagement portion (230) configured to engage with a first lip of a second decking board, optionally comprising an end section (234) being curved or forming an angle with respect to an overall lengthwise extension of the second engagement portion.

The invention claimed is:

1. A set of decking boards provided with a connecting system comprising a connecting device, the set of decking boards comprising:

a first decking board comprising a first side portion and a second decking board comprising a second side portion, each side portion extending along a longitudinal direction of the decking board, wherein each of said first and second side portions comprises:

a first lip and a second lip, wherein an extension of the second lip in a transverse direction of the decking board is larger than an extension of the first lip in said transverse direction of the decking board, wherein the first decking board is configured to be connected to a support element, and wherein the second decking board is configured to assume a vertically locked state with respect to the first decking board, wherein in said vertically locked state:

said connecting device cooperates with the first decking board and with the second decking board;

the first lip of the first decking board and the second lip of the second decking board are provided in a first horizontal plane, and the second lip of the first decking board and the first lip of the second decking board are provided in a second horizontal plane, said first and second horizontal planes each being parallel with a surface member of the first and/or the second decking board;

there is a vertical gap between a portion of the second lip of the first decking board and a portion of the second lip of the second decking board;

there is a first horizontal space between and fully separating the first lip of the first decking board and the second lip of the second decking board;

there is a second horizontal space located between the second lip of the first decking board and the first lip of the second decking board and configured such that the second side portion is displaceable in the horizontal transverse direction in the second horizontal plane in the vertically locked state, the connecting device occupying less than an entirety of the second horizontal space along the horizontal transverse direction in said vertically locked state; and wherein said connecting device engages with the first lip of the second decking board in said vertically locked state.

2. A set of decking boards according to claim 1, wherein at least a portion of each of the first and the second decking boards is symmetric under a 180 degrees rotation around a longitudinal axis of the decking board.

3. A set of decking boards according to claim 1, wherein an inner wall of the second lip of the first decking board is inclined with respect to the surface member of the first decking board or curved.

4. A set of decking boards according to claim 1, wherein the connecting device is provided in a first groove of the first decking board in said vertically locked state, and/or wherein the connecting device is provided in a second groove of the second decking board in said vertically locked state.

5. A set of decking boards according to claim 1, wherein the connecting device comprises a first and a second engagement portion configured to engage with the first and second decking board, respectively, in an installed state.

6. A set of decking boards according to claim 5, wherein said first and second engagement portions are configured to be provided at different vertical levels from the support member in an installed state.

7. A set of decking boards according to claim 1, wherein a vertical thickness of the second lip is larger than a vertical thickness of the first lip.

8. A set of decking boards according to claim 1, wherein the second side portion is displaceable in the horizontal longitudinal direction in the vertically locked state.

9. A set of decking boards according to claim 1, wherein said connecting device engages with the second lip of the first decking board in said vertically locked state.

10. A set of decking boards according to claim 1, wherein the connecting device is further configured to engage with said support element in said vertically locked state.

11. A set of decking boards according to claim 10, wherein the connecting device is configured to be connected to the support element.

12. A set of decking boards according to claim 1, wherein the connecting device engages with the second lip of the first decking board and/or with the first lip of the second decking board with pretension in an installed state.

13. A set of decking boards according to claim 1, wherein the connecting device comprises a protrusion configured to be disposed in a notch of the second lip of the first decking board in an installed state.

14. A set of decking boards according to claim 1, wherein a portion of the connecting device is configured to be provided in a recess of the second lip of the first decking board in an installed state.

15. A set of decking boards according to claim 1, wherein said portion of the second lip of the second decking board is provided above the portion of the second lip of the first decking board in said vertically locked state such that they form a horizontal overlap.

16. A set of decking boards according to claim 1, wherein the connecting device comprises:

a first engagement portion configured to engage with the second lip of the first decking board; and a second engagement portion configured to engage with the first lip of the second decking board.

17. A set of decking boards according to claim 16, wherein the first engagement portion comprises a hole for connecting the connecting device to the support element with an attaching element through the hole and the second lip of the first decking board.

18. A set of decking boards according to claim 16, wherein the second engagement portion comprises an end section being curved or forming an angle with respect to an overall lengthwise extension of the second engagement portion.

19. A set of decking boards provided with a connecting system comprising a connecting device, the set of decking boards comprising:

a first decking board comprising a first side portion and a second decking board comprising a second side portion, each side portion extending along a longitudinal direction of the decking board, wherein each of said first and second side portions comprises:

a first lip and a second lip, wherein an extension of the second lip in a transverse direction of the decking board is larger than an extension of the first lip in said transverse direction of the decking board, wherein the first decking board is configured to be connected to a support element, and wherein the second decking board is configured to assume a vertically locked state with respect to the first decking board, wherein in said vertically locked state:

said connecting device cooperates with the first decking board and with the second decking board;

the first lip of the first decking board and the second lip of the second decking board are provided in a first horizontal plane, and the second lip of the first decking board and the first lip of the second decking board are provided in a second horizontal plane, said first and second horizontal planes each being parallel with a surface member of the first and/or the second decking board;

there is a vertical gap between a portion of the second lip of the first decking board and a portion of the second lip of the second decking board; and there is a horizontal space between and fully separating the first lip of the first decking board and the second lip of the second decking board, wherein said connecting device engages with the first lip of the second decking board in said vertically locked state, and wherein the connecting device comprises at least one tooth which is configured to engage with an upper portion of the second lip of the first decking board in the vertically locked state, and which extends from an upper portion of the connecting device onto the upper portion of the second lip in the vertically locked state.

20. A set of decking boards according to claim 1, wherein the connecting device is configured to cooperate with the support element via an attaching element.

21. A set of decking boards according to claim 20, wherein the attaching element is provided through the second lip of the first decking board and a portion of the connecting device is arranged between the second lip of the first decking board and the support element in the vertically locked state.

22. A set of decking boards according to claim 21, wherein the attaching element is provided outside of the connecting device in the vertically locked state.

23. A set of decking boards according to claim 21, wherein the attaching element is provided through the connecting device in the vertically locked state.

24. A set of decking boards according to claim 21, further comprising the attaching element.

* * * * *